US007762895B2

(12) United States Patent
Zamperla et al.

(10) Patent No.: US 7,762,895 B2
(45) Date of Patent: Jul. 27, 2010

(54) AMUSEMENT APPARATUS WITH MOVABLE FLOOR PORTION

(75) Inventors: Alberto Zamperla, Vicenza (IT); Antonio Nardin, Creazzo (IT)

(73) Assignee: Antonio Zamperla S.p.A., Vicenza (IT)

( * ) Notice: Subject to any disclaimer, the term of this patent is extended or adjusted under 35 U.S.C. 154(b) by 495 days.

(21) Appl. No.: 11/542,362

(22) Filed: Oct. 2, 2006

(65) Prior Publication Data

US 2008/0081706 A1 Apr. 3, 2008

(51) Int. Cl.
*A63G 1/34* (2006.01)
*A63G 1/00* (2006.01)

(52) U.S. Cl. ..... 472/43; 472/47; 105/3

(58) Field of Classification Search ..... 472/43, 472/59–61, 160, 136, 47; 105/3, 4.1, 8.1; 280/403

See application file for complete search history.

(56) References Cited

U.S. PATENT DOCUMENTS

| | | | | |
|---|---|---|---|---|
| 533,722 | A | 2/1895 | Moeri | |
| 2,005,400 | A | 6/1935 | Stoehrer et al. | |
| 3,006,642 | A | 10/1961 | Bartlett | |
| 3,203,364 | A | 8/1965 | Gutridge | |
| 3,602,545 | A * | 8/1971 | Lindenbauer | 296/156 |
| D226,931 | S | 5/1973 | Wormser | |
| 3,993,304 | A | 11/1976 | Ahrens | |
| 4,313,639 | A | 2/1982 | Ware | |
| 4,425,296 | A * | 1/1984 | Adamowski et al. | 376/245 |
| 4,531,459 | A | 7/1985 | Yamada | |
| 4,548,136 | A | 10/1985 | Yamada | |
| 5,226,367 | A | 7/1993 | McLaughlin | |
| 5,342,116 | A | 8/1994 | Walton | |
| D366,513 | S | 1/1996 | Crowe et al. | |
| D382,324 | S | 8/1997 | Shinzato | |
| 5,827,123 | A | 10/1998 | Reverchon | |
| 5,833,544 | A | 11/1998 | Corbin et al. | |
| 5,887,943 | A | 3/1999 | Lee | |
| 5,979,333 | A | 11/1999 | Houben et al. | |
| 6,167,814 | B1 * | 1/2001 | Sugimoto et al. | 105/3 |

(Continued)

FOREIGN PATENT DOCUMENTS

| | | |
|---|---|---|
| DE | 202 17 754 | 2/2003 |

(Continued)

OTHER PUBLICATIONS

Prestigious IAAPA "Best New Product Award" for Vekoma Rides Manufacturing, IAAPA Orlando 2004 Award Winner, 1 page.

(Continued)

*Primary Examiner*—Kien T Nguyen
(74) *Attorney, Agent, or Firm*—Kenyon & Kenyon LLP

(57) ABSTRACT

An amusement apparatus includes at least a pair of interconnected platforms configured to move on a track. A seat may be connected to at least one of the platforms and may include, for example, a support and an immobilization device for immobilizing the user on the support suitable for acting on the user's back. The seat may optionally have a motorcycle shape and may include handlebars and retractable leg extensions projecting from each side of the seat for maintaining a user's legs in a crouched motorcycle riding position. At least one of the platforms may include a bridging portion to bridge a gap between the platforms during, for example, loading and unloading of the amusement apparatus with riders.

21 Claims, 31 Drawing Sheets

U.S. PATENT DOCUMENTS

| | | | | |
|---|---|---|---|---|
| 6,206,399 | B1 | 3/2001 | Schnitzenbaumer | |
| 6,276,282 | B1 * | 8/2001 | Schunke | 105/4.1 |
| 6,287,211 | B1 | 9/2001 | Bolliger et al. | |
| 6,568,699 | B2 | 5/2003 | McCann | |
| 6,884,177 | B2 | 4/2005 | Zambelli et al. | |
| 6,971,316 | B2 | 12/2005 | Hansen et al. | |
| 6,976,923 | B1 | 12/2005 | Clarke et al. | |
| 6,983,992 | B2 | 1/2006 | Oomori | |
| 2002/0070599 | A1 | 6/2002 | Berra | |
| 2004/0032157 | A1 | 2/2004 | Trimborn | |
| 2005/0001466 | A1 | 1/2005 | Zambelli et al. | |
| 2005/0175968 | A1 | 8/2005 | Milner | |
| 2005/0197195 | A1 | 9/2005 | Zamperla et al. | |
| 2006/0063137 | A1 | 3/2006 | Robbins | |

FOREIGN PATENT DOCUMENTS

| | | |
|---|---|---|
| EP | 1 215 091 | 6/2002 |
| EP | 1 020 213 | 3/2004 |
| WO | 2004/073818 | 9/2004 |

OTHER PUBLICATIONS

Booster Bike, Vekoma Rides Manufacturing and Toverland, www.rcdb.com/document122.htm, printed on Apr. 12, 2006.

Werner, "How to Ride Fast on a Motorcycle—and not get caught!", www.motorbiker.org/blogs.nsf/dx/11082004193615MWEPTO.htm, printed on Apr. 12, 2006.

FKF Award 2004, Vekoma Rides Manufacturing B.V., 1 page.

Motorbike Coaster, http://www.vekoma.com/rides_fam_coasters/motorbike_coaster.htm, printed on Mar. 10, 2006, 1 page.

Motobike Coaster, Family Coasters, Vekoma Rides Manufacturing B.V., 2 pages.

International Search Report, International Application No. PCT/EP2005/006251 filed Jun. 10, 2005.

International Search Report, International Application No. PCT/IB2007/004183 filed Oct. 2, 2007.

* cited by examiner

AMUSEMENT APPARATUS WITH MOVABLE FLOOR PORTION

INCORPORATION BY REFERENCE

Each of U.S. patent application Ser. No. 10/991,547, filed on Nov. 17, 2004 and U.S. patent application Ser. No. 10/726,830, filed on Dec. 3, 2003, is expressly incorporated herein in its entirety by reference thereto.

FIELD OF THE INVENTION

The present invention relates to an amusement apparatus with a movable floor portion.

BACKGROUND INFORMATION

In amusement apparatus, the user or passenger is generally seated on a suitable seat. For reasons of safety, the seat is often provided with devices for immobilizing the user on the support of the seat such that the user is firmly held in his seat despite the movements performed by the amusement apparatus.

A seat for amusement apparatus including a fixed back and a fork hinged on the back above the user is, for example, conventional. The fork descends and immobilizes the user's shoulders and chest against the fixed back.

A seat having this configuration immobilizes the user on the support of the seat, ensuring his safety, but does not allow the spectator to make movements of any kind, thus for example diminishing the ride sensation provided by the amusement apparatus, or one of the sensations which it is attempted to generate in order to render the amusement apparatus exciting.

Thus, there is believed to be a constant need to construct amusement apparatus which can generate new sensations for users. There is also believed to be a constant need to facilitate entry and exit of amusement apparatus, both for ease and for safety.

SUMMARY

According to an example embodiment of the present invention, an amusement apparatus includes: a first platform configured to move on a track; a second platform configured to move on the track and interconnected with the first platform; and a bridge portion connected to a first one of (a) the first platform and (b) the second platform and moveable in a direction of a second one of (a) the first platform and (b) the second platform between a retracted position, in which a gap is formed between the first platform and the second platform, and an extended position, in which the bridge portion extends between the first platform and the second platform.

The bridge portion may be pivotally connected to the first one of (a) the first platform and (b) the second platform and may be moveable between the extended position, in which the bridge portion one of (a) contacts and (b) is suspended over the second one of (a) the first platform and (b) the second platform and bridges the gap between the first platform and the second platform, and the retracted position, in which the bridge portion is at a higher angle, relative to the first one of (a) the first platform and (b) the second platform, than in the extended position.

The amusement apparatus may include a pulley interconnecting the first and second platforms.

The amusement apparatus may include: a first axle connected to an underside of the first platform; and a second axle connected to an underside of the second platform, the first axle and the second axle configured to support the first and second platforms on the at least one track. The pulley may be pivotally connected on one end to at least one of (a) the first axle and (b) the second axle.

The first platform may lead the second platform on the track.

The amusement apparatus may include a pneumatic piston configured to move the bridge portion between the extended position and the retracted position.

The bridge portion may be adapted to remain in the extended position during a loading and unloading operation of the amusement apparatus and in a loading and unloading area of the amusement apparatus.

The amusement apparatus may include at least one seat connected to at least one of (a) the first platform and (b) the second platform. The seat may include: (i) a support configured to receive a rider astride the support; and (ii) an arrangement configured to immobilize the rider on the support. The arrangement may be configured to maintain shoulders of the rider free and to secure the rider on the support at at least one of (a) an abdominal portion of the rider and (b) a thoracic portion of the rider.

The seat may include a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

The support may include a seat portion and a front support member and may be configured to receive the rider astride the seat portion. The arrangement may be configured to secure the rider at least against the front support member at at least one of the abdominal portion of the rider and the thoracic portion of the rider.

The support may include a seat portion and a front portion situated higher than the seat portion and angled such that the rider sitting astride on the seat portion must lean forward into a forward leaning posture for at least one of the rider's (a) abdominal and (b) thoracic regions to contact the front portion of the rider support. The arrangement may include a restraint moveable between a first position not contacting the rider in the forward leaning posture and a second position in which at least a portion of the restraint contacts at least a back portion of the rider in the forward leaning posture and is configured to maintain the rider in said forward leaning posture.

The seat portion of the seat may be elongated, and a longitudinal axis of the seat portion may be arranged to follow the track.

Each platform may include two seats side-by-side.

The bridge portion may be located one of (a) between a leading platform and a trailing platform and (b) between laterally adjacent platforms.

According to an example embodiment of the present invention, a method for operating an amusement apparatus, which includes a track and a vehicle movable along the track, includes: (a) while the movable vehicle is located in a loading and unloading position, moving a bridge portion of the vehicle into an extended position between two adjacent platforms of the vehicle, in the extended position, the bridge portion extending between the platforms and spanning a gap between the platforms; (b) after the step (a), moving the bridge portion from the extended position to a retracted position in which the bridge portion does not extend between the platform and does not span the gap between the platforms; (c) after the step (b), moving the vehicle along the track from the loading and unloading position and returning the track to the loading and unloading position; and (d) after the step (c), repeating the step (a).

The method may include at least one of (a) loading and (b) unloading passengers into the vehicle between the step (a) and the step (b).

The method may include at least one of (a) loading and (b) unloading passengers into the vehicle between the steps (c) and (d).

The bridge portion may be pivotally connected one of the platforms, the step (a) may include pivoting the bridge portion into the extended portion, and the step (b) may include pivoting the bridge portion into the retracted position.

The method may include immobilizing riders on at least one of the platforms at least one of (a) prior to and (b) simultaneously with the step (d).

The amusement apparatus may include at least one seat connected to at least one of the platforms.

The bridge portion may be located one of (a) between leading and trailing platforms and (b) between laterally adjacent platforms.

Example embodiments of the present invention are described in more detail below with reference to the appended Figures.

DETAILED DESCRIPTION

A seat for amusement apparatus is indicated as a whole by 10. As illustrated, seat 10 is constructed such that the passenger or user sits astride the same, adopting a posture similar to that adopted by motorcyclists.

In addition to this the structure of the seat is such as to leave the passenger's shoulders free, securing him in the vicinity of the chest or abdomen.

Seat 10 includes a support 12 supported by a frame 14. For example support 12 is in the shape of a saddle or motor vehicle seat so as to receive the passenger sitting astride the same. Frame 14 is, for example, constructed of a set of tubular members, although other arrangements such as compact and boxed structures are possible.

Figure 6:
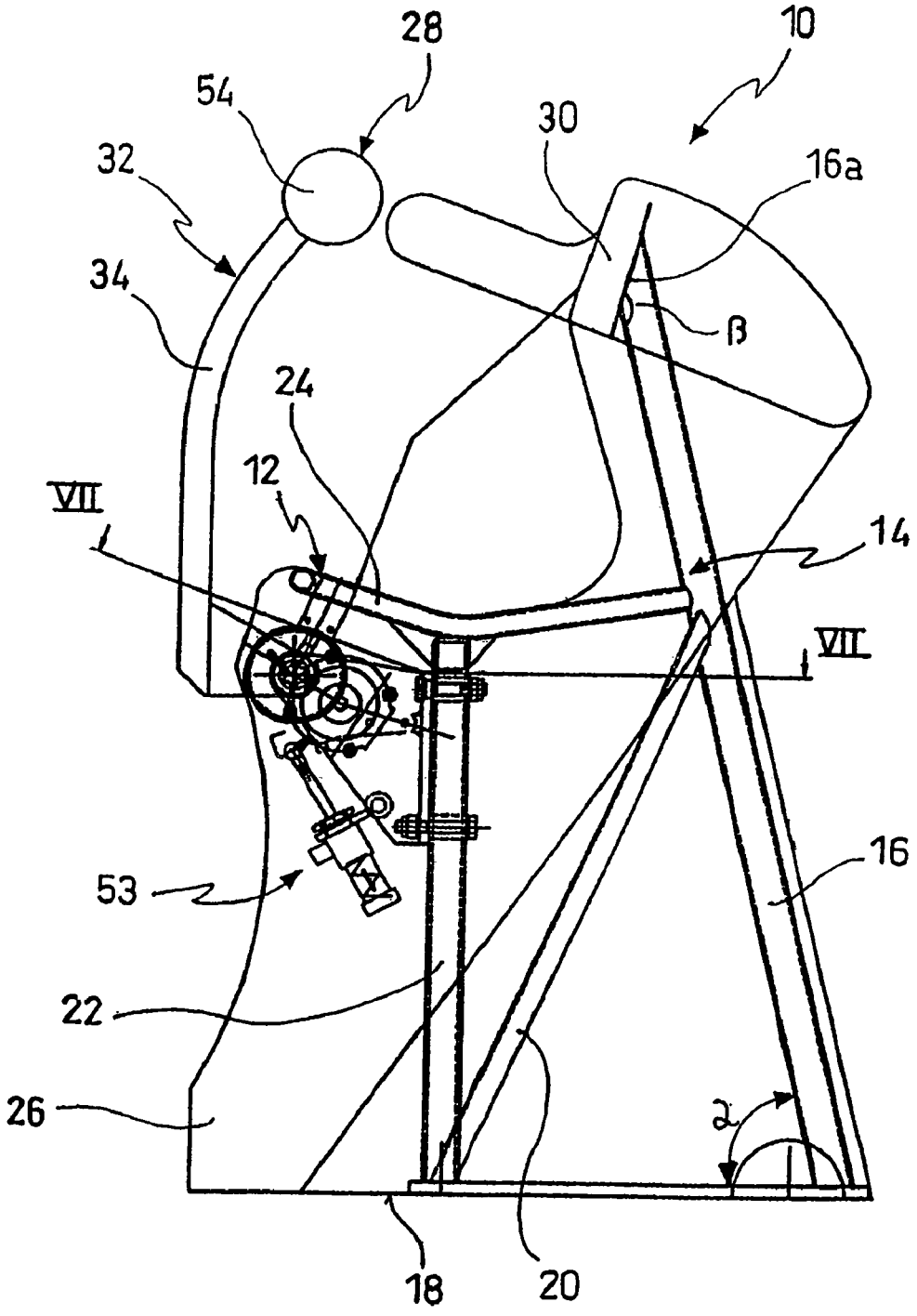
FIG. 6 is a side view of the seat illustrated in FIG. 1.

FIG. 6 illustrates frame 14 in which frontal supporting member 16 is fixed to a floor 18. Frontal supporting member 16 extends from floor 18, e.g., in a direction which is inclined at an angle of a with respect to the floor.

The extremity of the frontal supporting member opposite floor 18 ends in a portion 16*a* which may be inclined at an angle β with respect to the frontal supporting member. Portion 16*a* is suitable for supporting a cushion to support the passenger, which is, for example, manufactured from polyurethane.

Two lateral supporting members 20 extend from frontal supporting member 16 and floor 18. Further supporting members 22 extend in a direction substantially perpendicular to floor 18 and constitute a support for supporting members 24 for support 12.

A cover or casing 26 completely encloses frame 14 of seat 10.

Reference numeral 28 indicates a device for immobilizing the user on support 12 of the seat. The immobilizing device may include at least one support 30 mounted at the end of frontal supporting member 16 in the vicinity of portion 16*a*. Support 30 is located frontally with respect to the user and may have a shape such as to wrap round the passenger both at the front and at the side. For example, support 30 includes a central portion 30*a* which may include a supporting member for a frontal portion of the user, for example, the chest in the case of children or the abdomen in the case of adults. Two side portions 30*b*, which may be arched, may also be provided and may extend from central portion 30*a* and may have a configuration such as to surround the passenger laterally.

Figure 5:
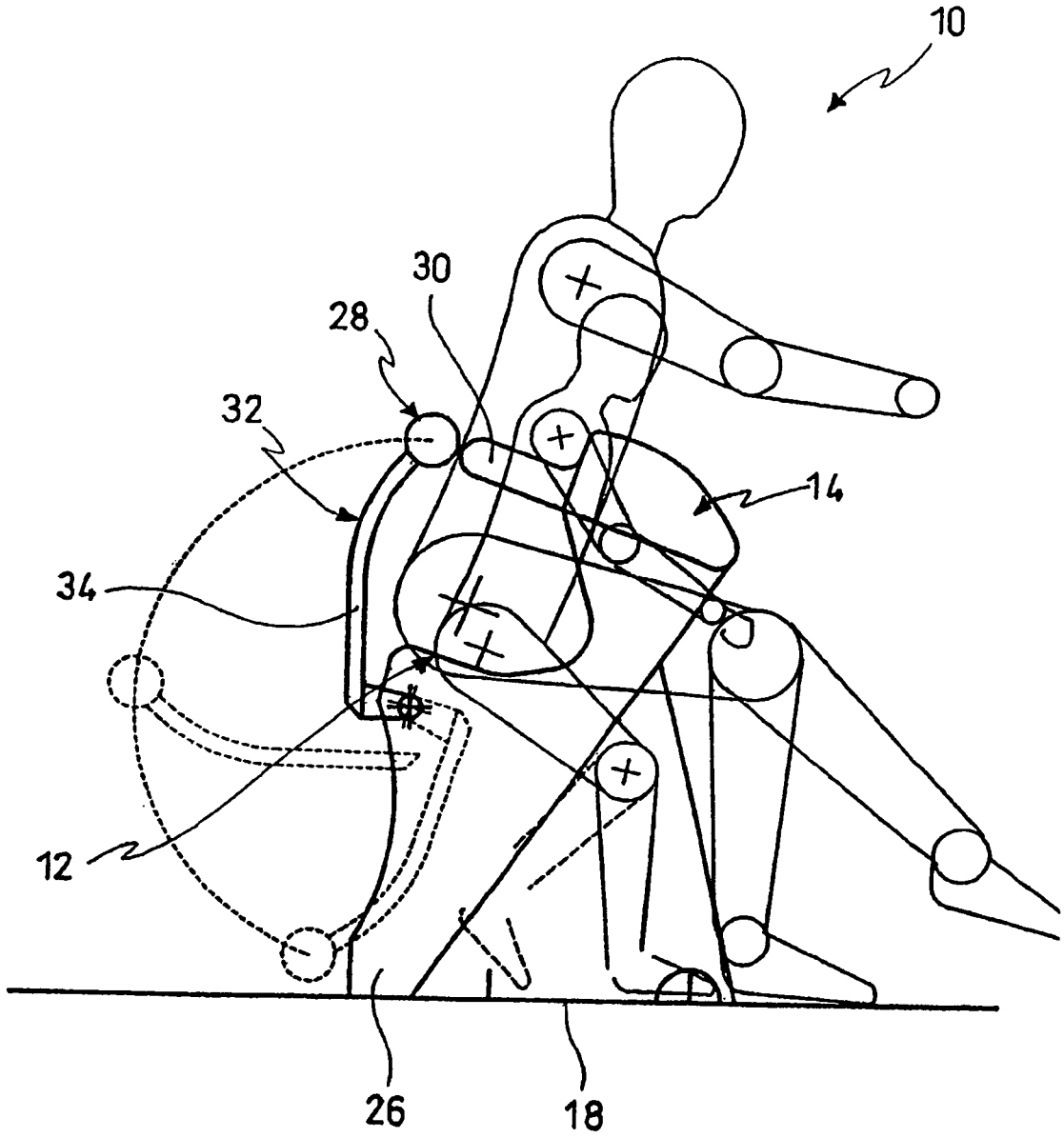
FIG. 5 is a side view of the seat illustrated in FIG. 1 illustrating the position of the user, whether a child or an adult.

Immobilizing device 28 may also include an opposing device 32 suitable for acting against the user's back. The opposing device is movable between an open position and a closed position in which it abuts against the user's back. FIG. 5 illustrates three positions of the opposing device corresponding to the open position (lowered position illustrated by a dashed line), the closed position (raised position illustrated by the unbroken line) and a position intermediate between the open position and the closed position (illustrated by a dashed line).

Opposing device 32 includes an arm 34 which is movable between a lowered position in which the user can sit down on the support of the seat and a raised position in which one end of the arm abuts against the user's back (see, e.g., FIG. 5). Arm 34 may be suitable for rotating with respect to support 12 and may be operatively associated with a rotating actuator 36. Actuator 36 may be pneumatic, hydraulic or electrical, etc.

One end of arm 34 may be keyed onto a splined shaft 38 mounted on frame 14.

Figure 7:
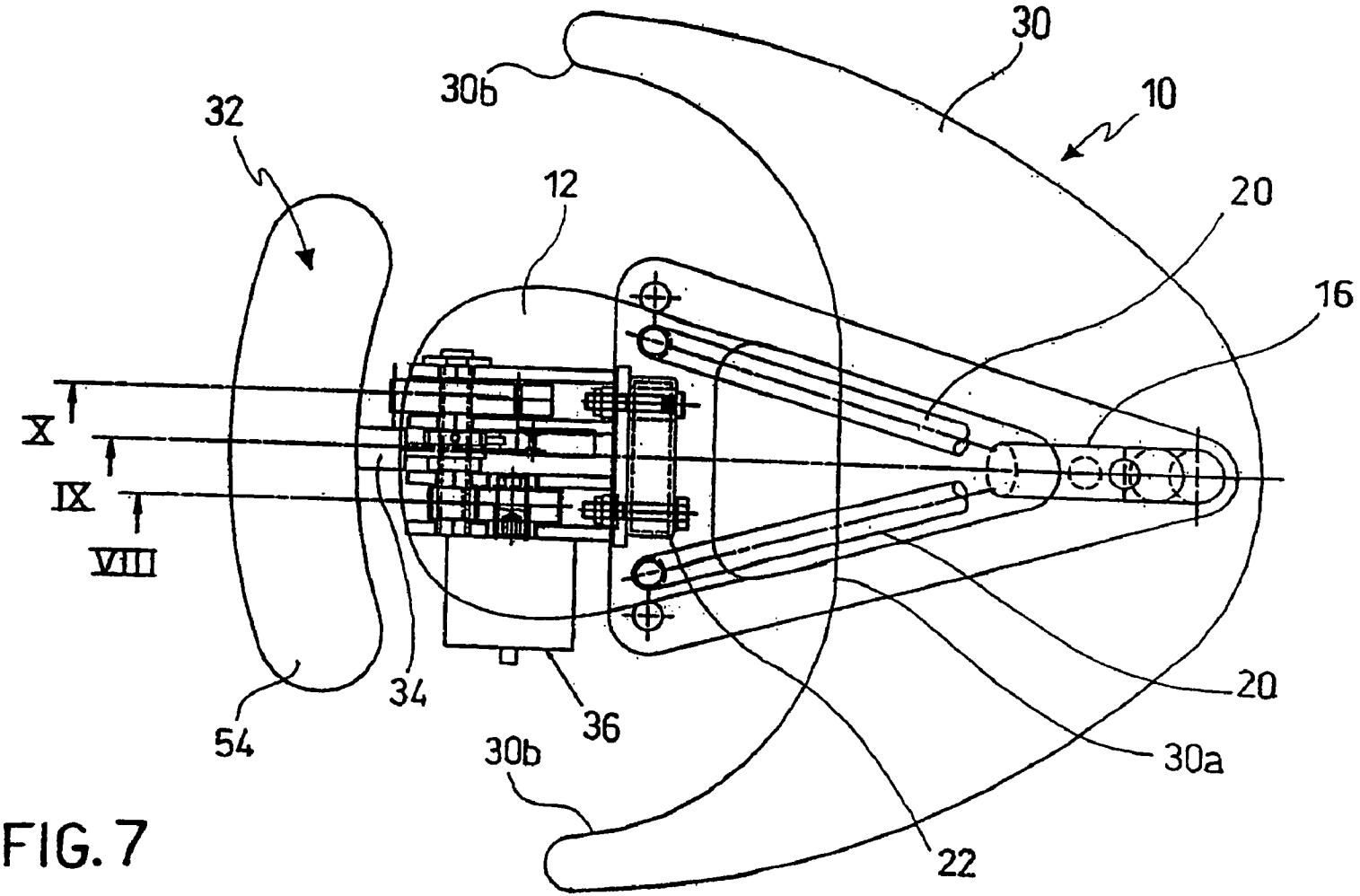
FIG. 7 is a view of the seat illustrated in FIG. 1 from above in which some components are in cross-section along the line VII-VII illustrated in FIG. 6.
Figure 8:
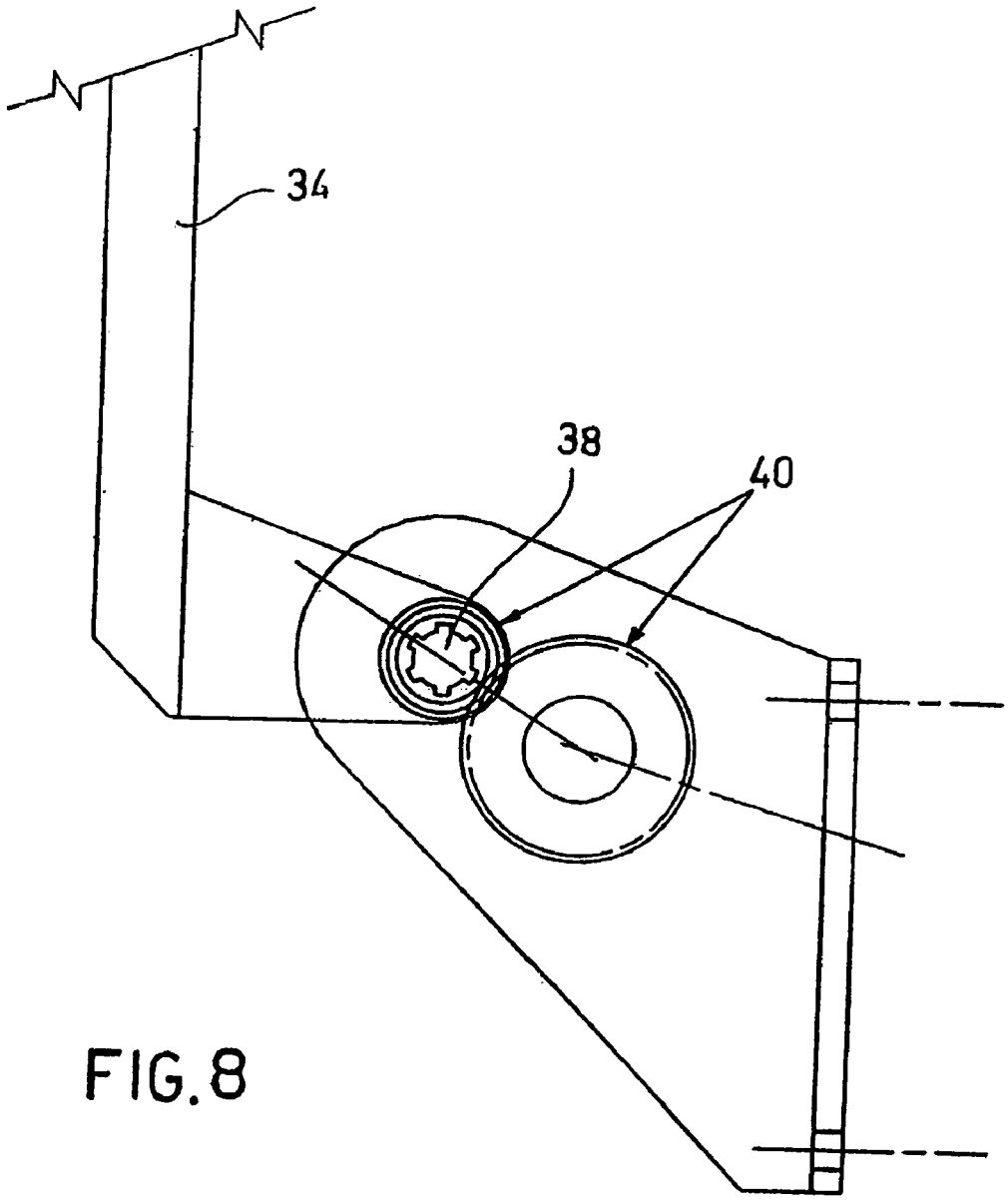
FIG. 8 is a view of a detail illustrated in FIG. 7 in cross-section taken along the line VIII-VIII.

A gear 40 is suitable for being caused to rotate by rotating actuator 36 and transmit the motion to splined shaft 38 (see, e.g., FIGS. 7 and 8).

Arm 34 is operatively associated with a cam 42 and a microswitch 44, e.g., through splined shaft 38 (see, e.g., FIGS. 7 and 8) with the function of checking that the opposing device has passed beyond a particular vertical position so as to ensure that the passenger is held.

Cam 42 has a first circular profile which extends over approximately three quarters of the total perimeter of the cam and a second circular profile of smaller radius than the first circular profile which extends over approximately one quarter of the total perimeter of the cam. The two profiles are suitably connected.

Microswitch 44 includes a runner 46 which is hinged to a body of the microswitch and is provided at one end with a small wheel 48 which rotates with respect to the runner and can move over the profile of cam 42.

Figure 10:
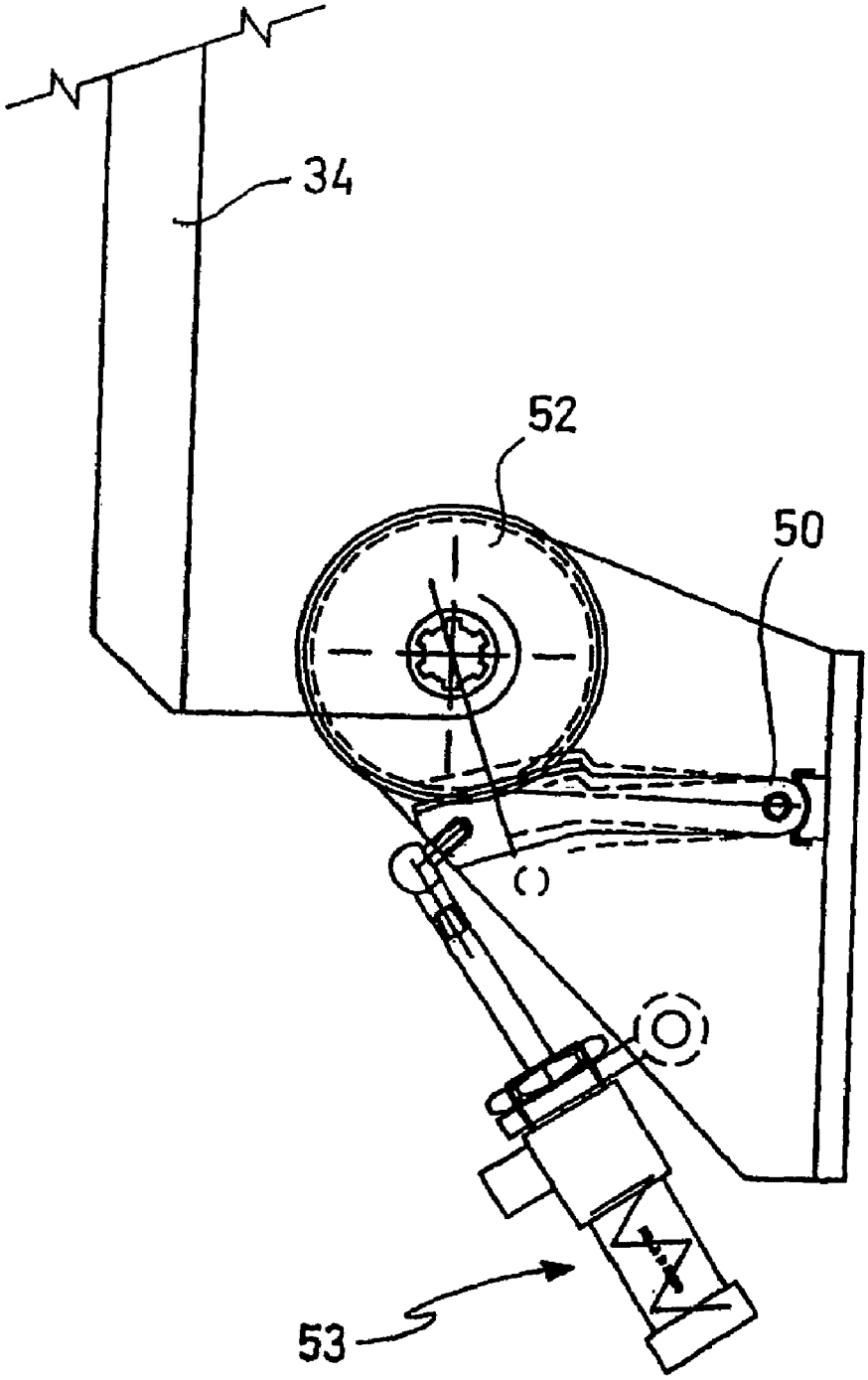
FIG. 10 is a view of a detail illustrated in FIG. 7 in cross-section taken along the line X-X.

Arm 34 is operatively associated with a device for immobilizing it in the raised position, for example, including a rack 50 hinged on frame 14. For example, the rack is associated with a toothed wheel 52 keyed onto splined shaft 38 to mechanically immobilize the opposing device in the raised position when it has reached the position in which it supports the passenger (see, e.g., FIGS. 7 and 10). Rack 50 and toothed wheel 52 therefore provide an immobilizing device of the mechanical type to prevent movement of the opposing device either as a result of the movements of the amusement apparatus or the thrust of the passenger against the opposing device, preventing the passenger from being thrown out of the seat.

Rack 50 is kept in contact with and in mesh with toothed wheel 52, activated, for example, by a single-action pneumatic piston. For example, rack 50 is held against toothed wheel 52 by a resilient device which may be disabled, for example, pneumatically, during the return movement of the opposing device.

One end 54 of arm 34 can wrap partly round the user's back.

Figure 1:
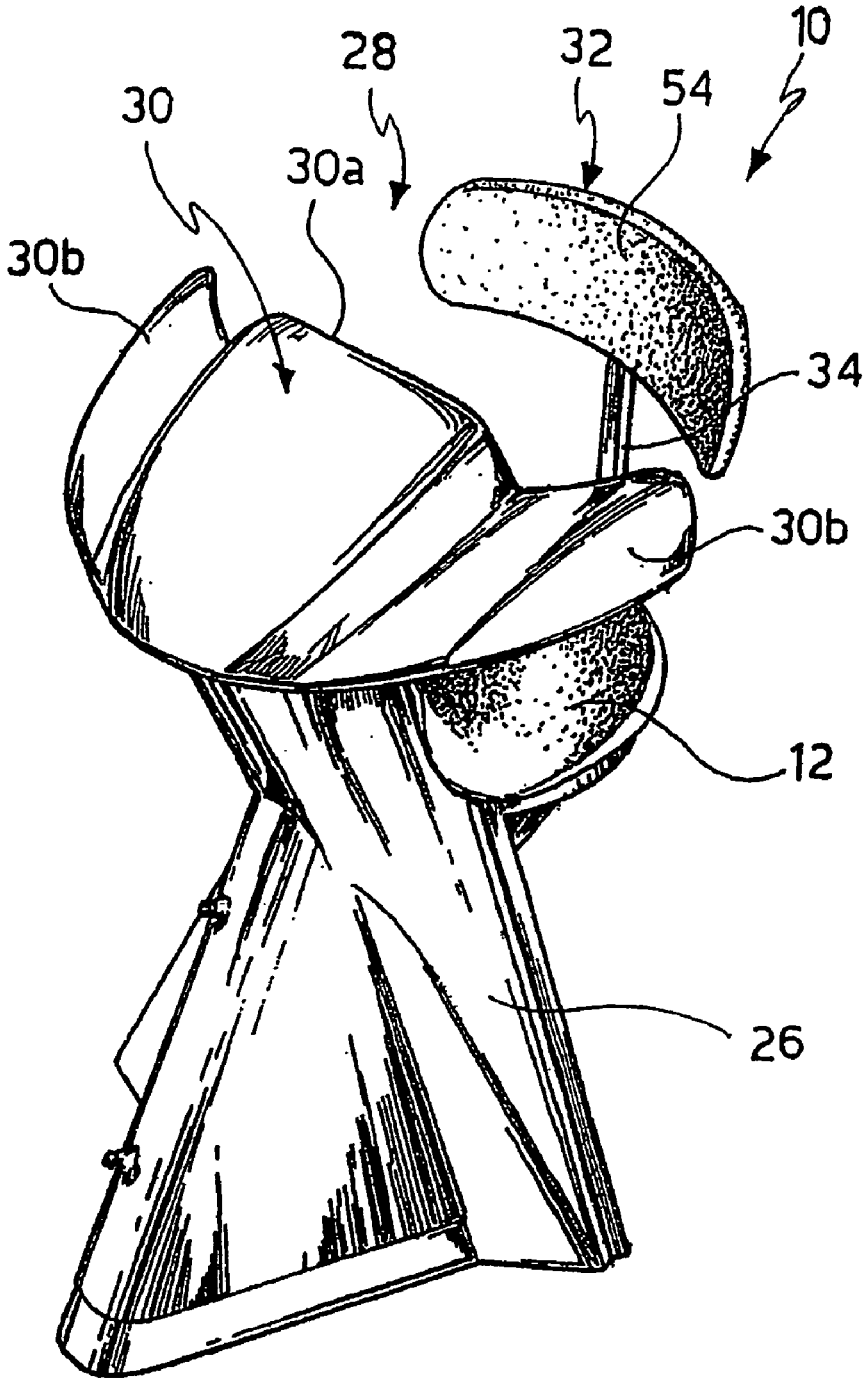
FIG. 1 is a perspective view of a seat of an amusement apparatus.
Figure 2:
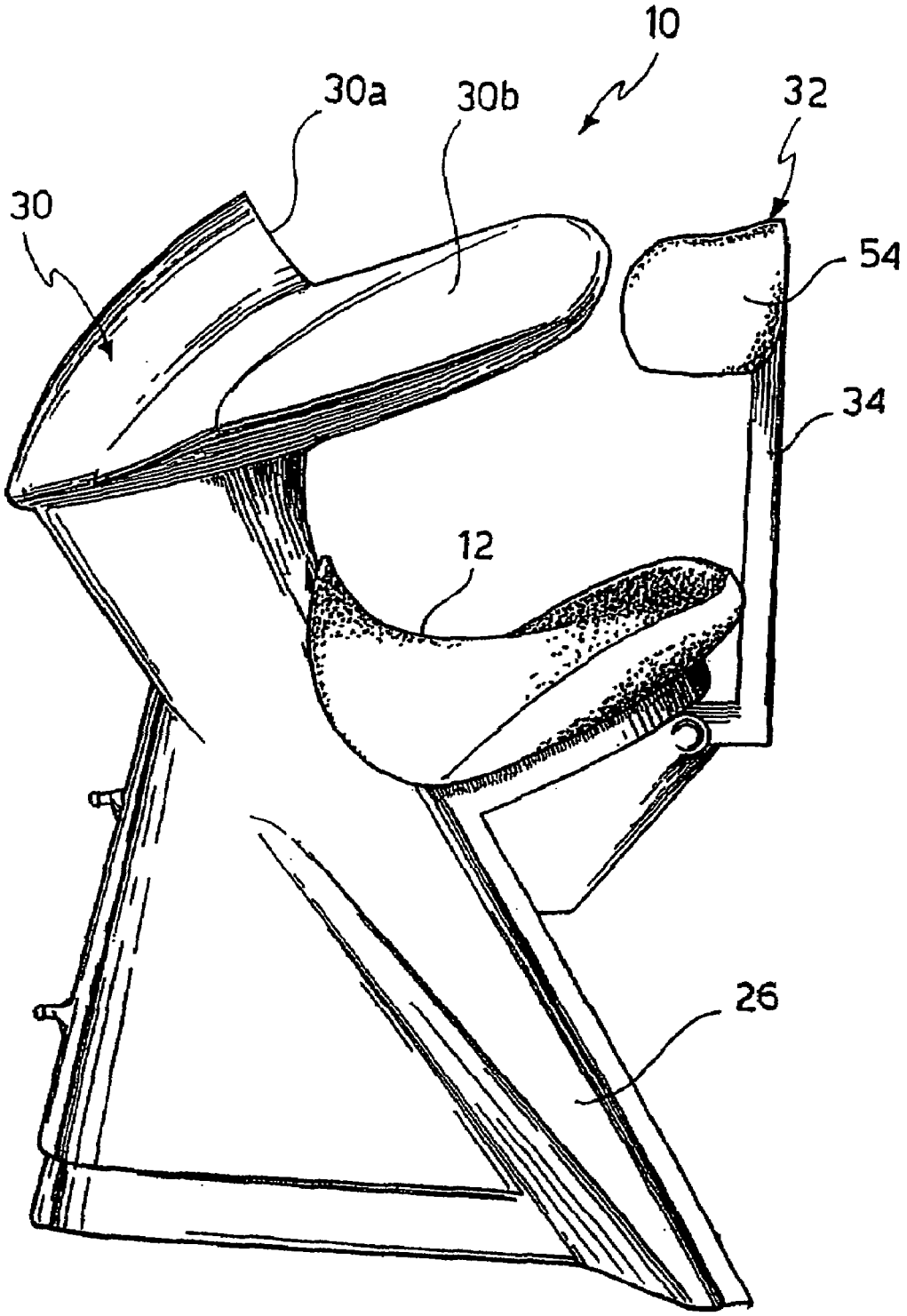
FIG. 2 is a side view of the seat illustrated in FIG. 1.
Figure 3:
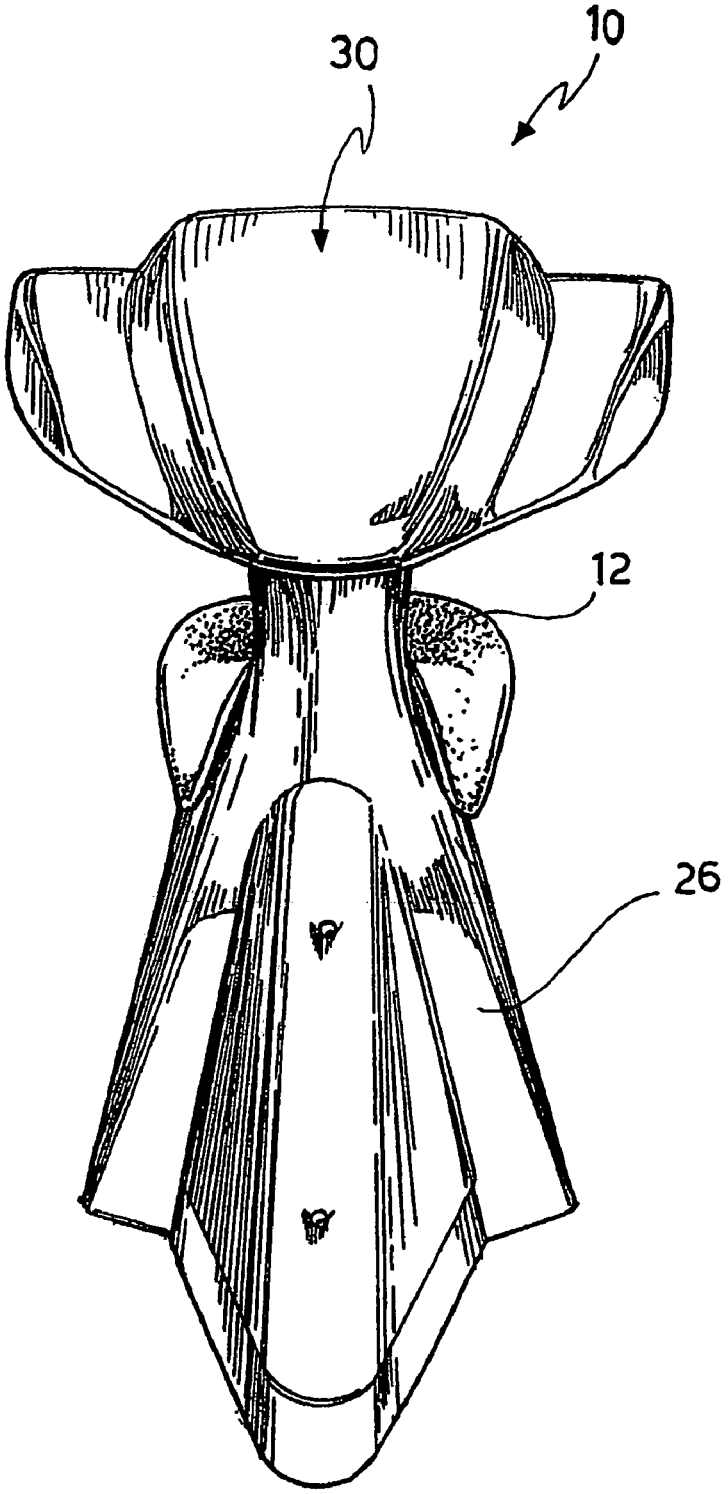
FIG. 3 is a frontal view of the seat illustrated in FIG. 1.
Figure 4:
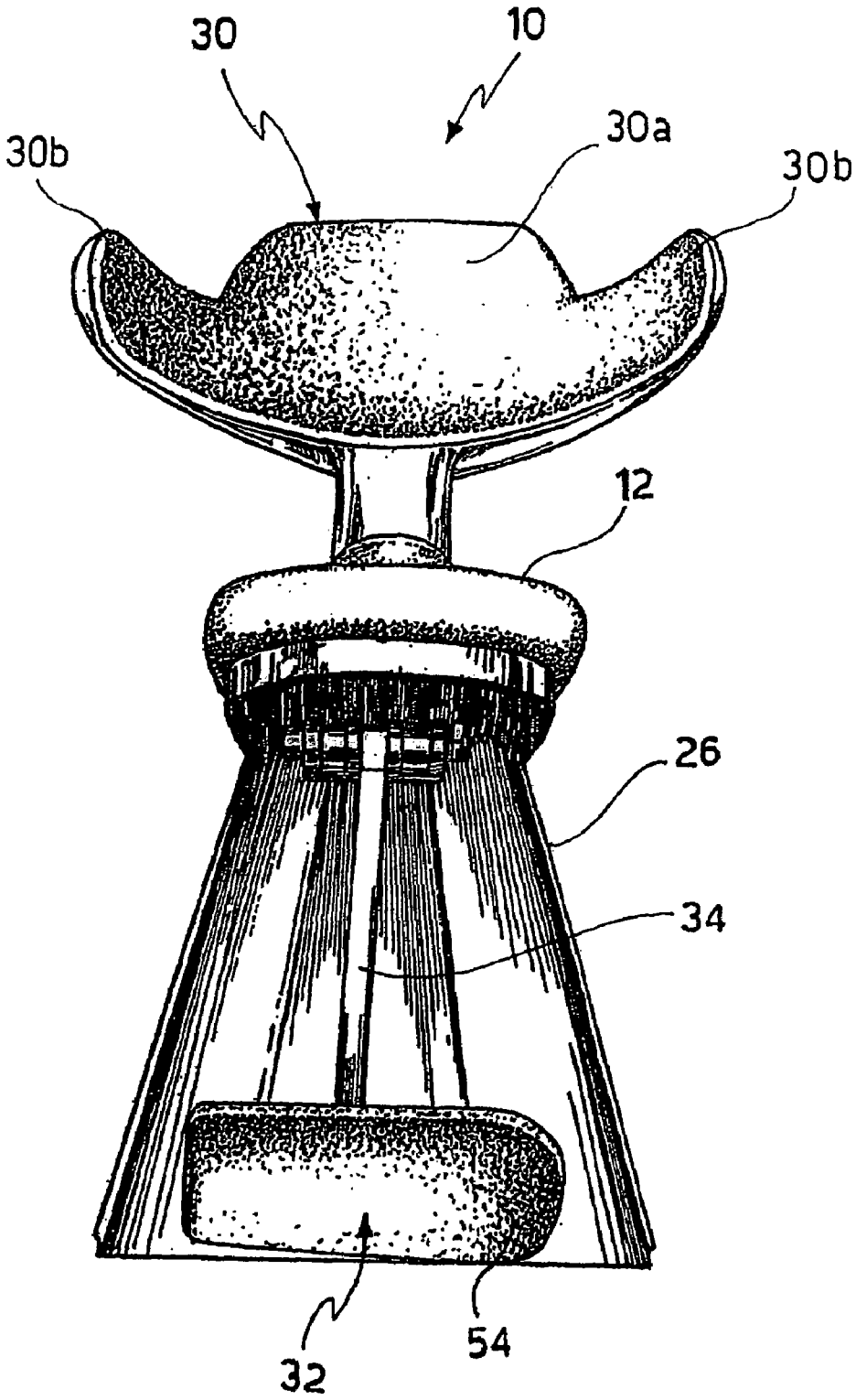
FIG. 4 is a rear view of the seat illustrated in FIG. 1.
Figure 13:
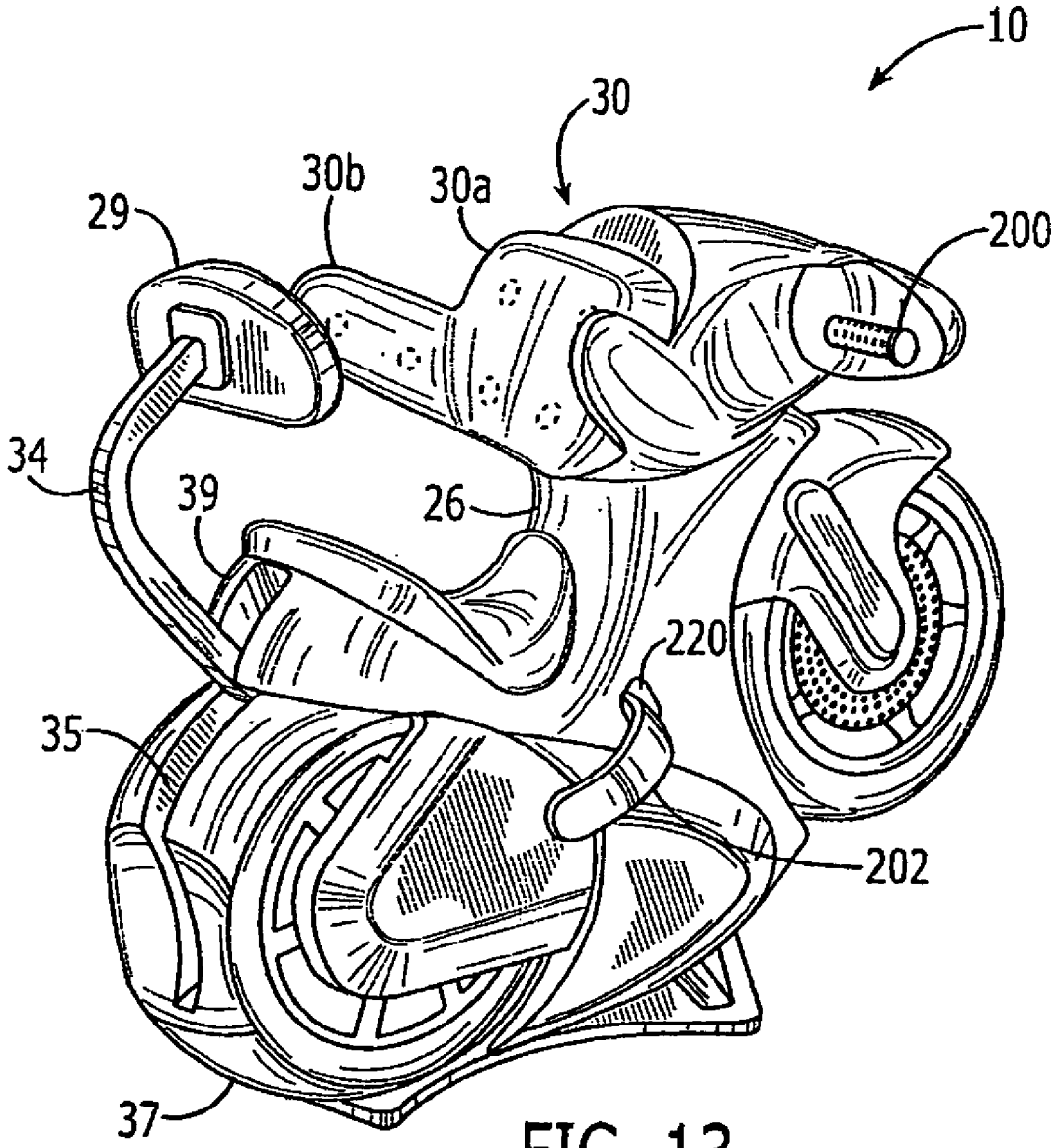
FIG. 13 is a perspective view of a seat of an amusement apparatus.
Figure 13A:
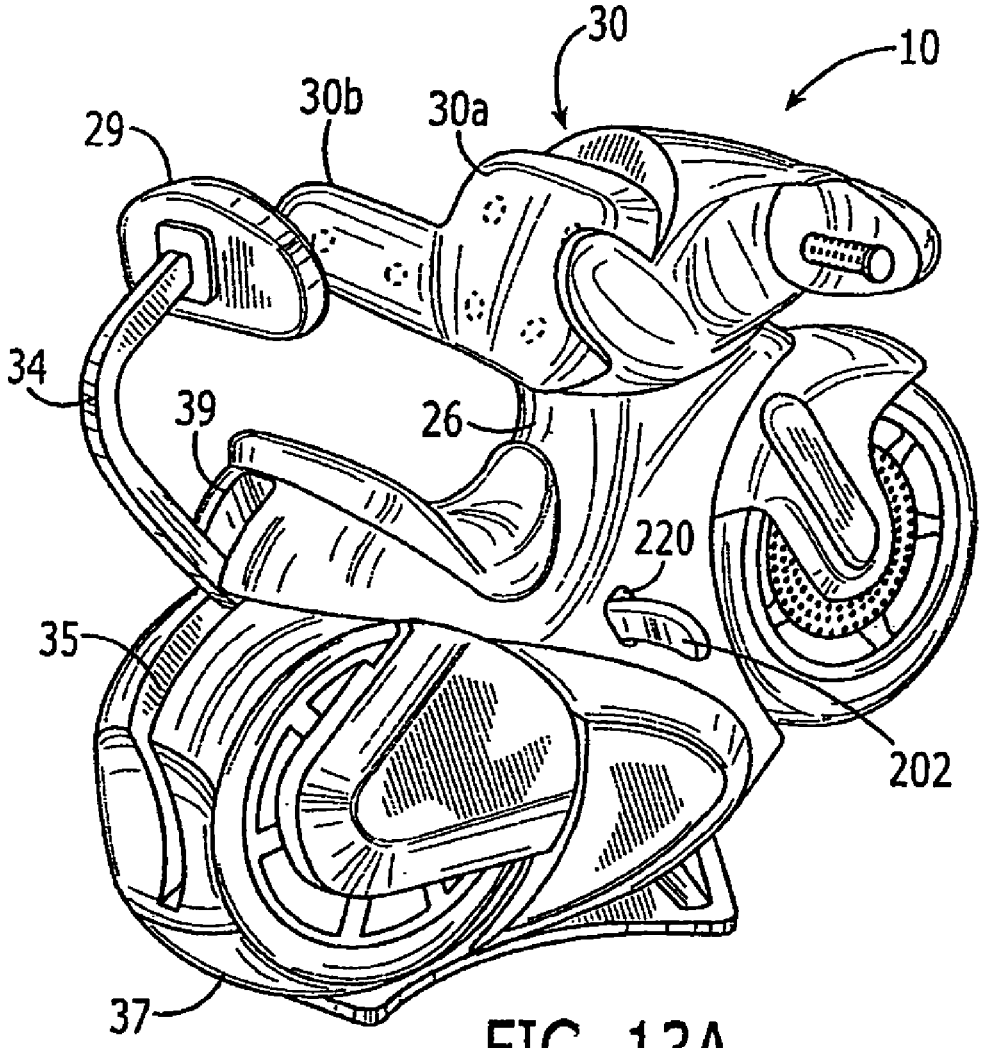
FIG. 13A is a perspective view of a seat of an amusement apparatus.
Figure 13B:
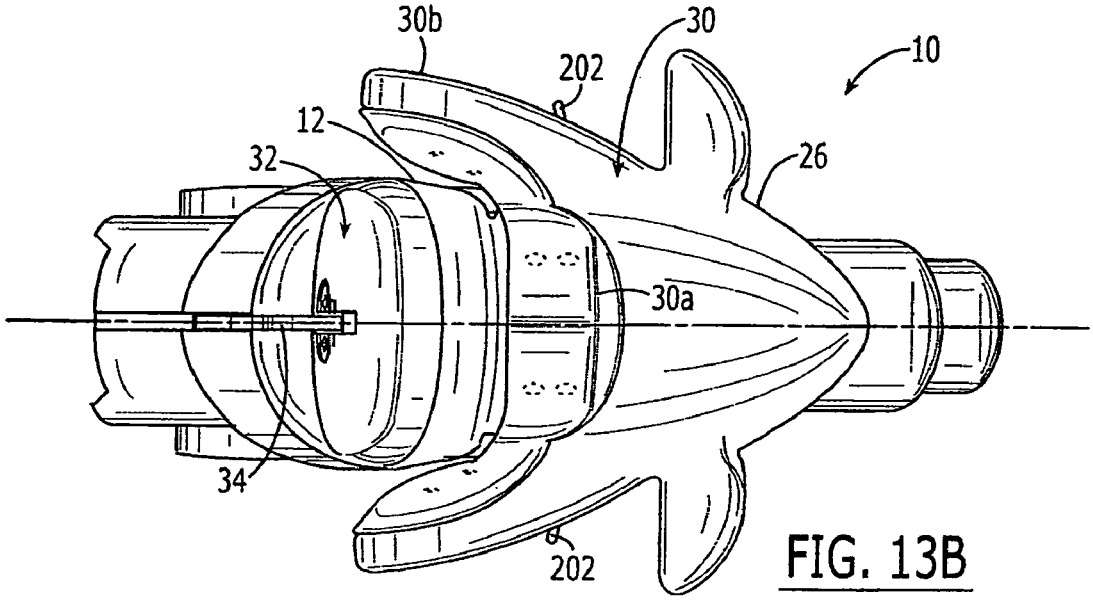
FIG. 13B is a top view of the seat illustrated in FIG. 13A.
Figure 13C:
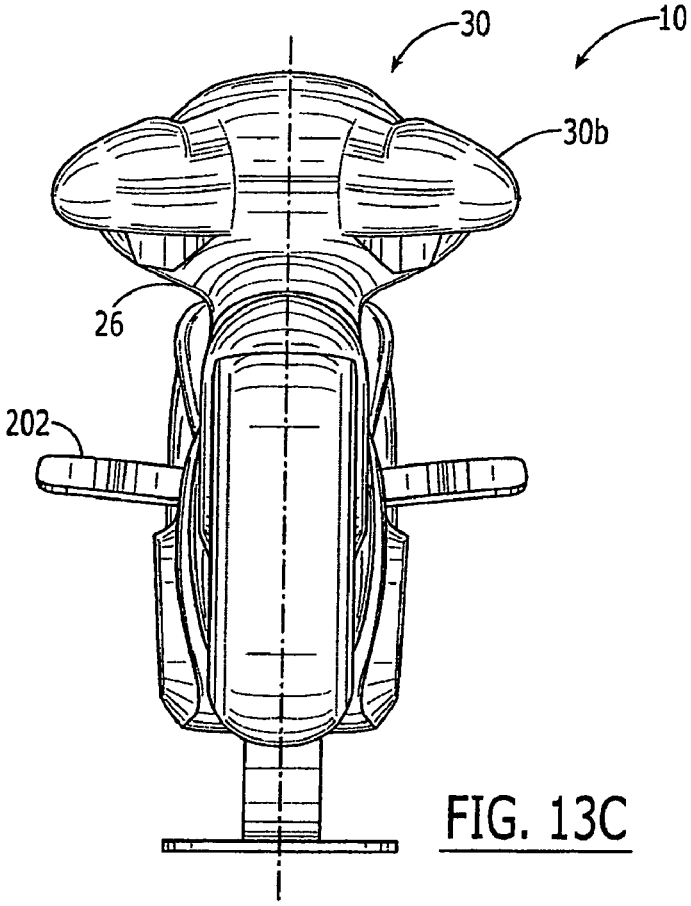
FIG. 13C is a front view of the seat illustrated in FIG. 13A.
Figure 13D:
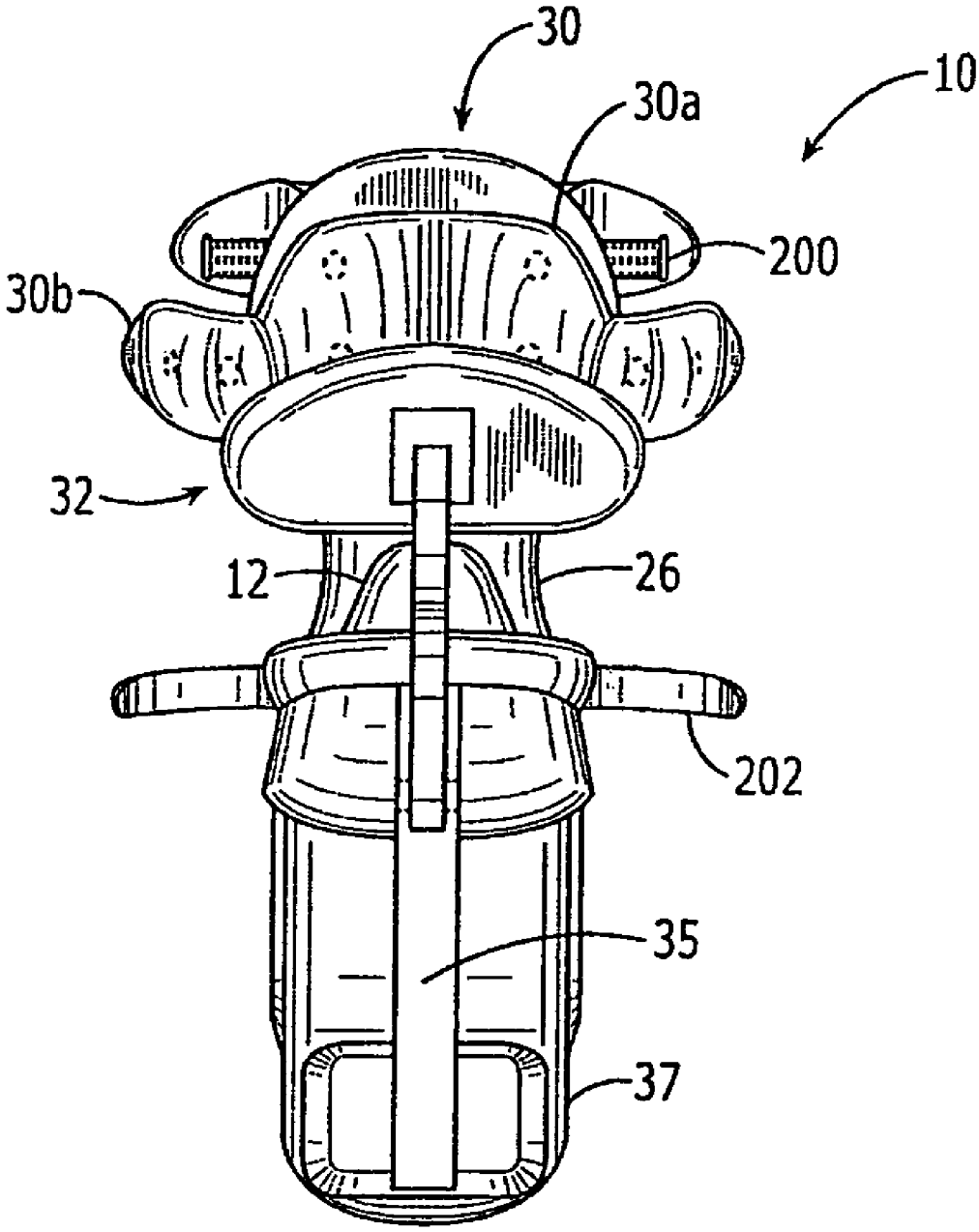
FIG. 13D is a back view of the seat illustrated in FIG. 13A.
Figure 13E:
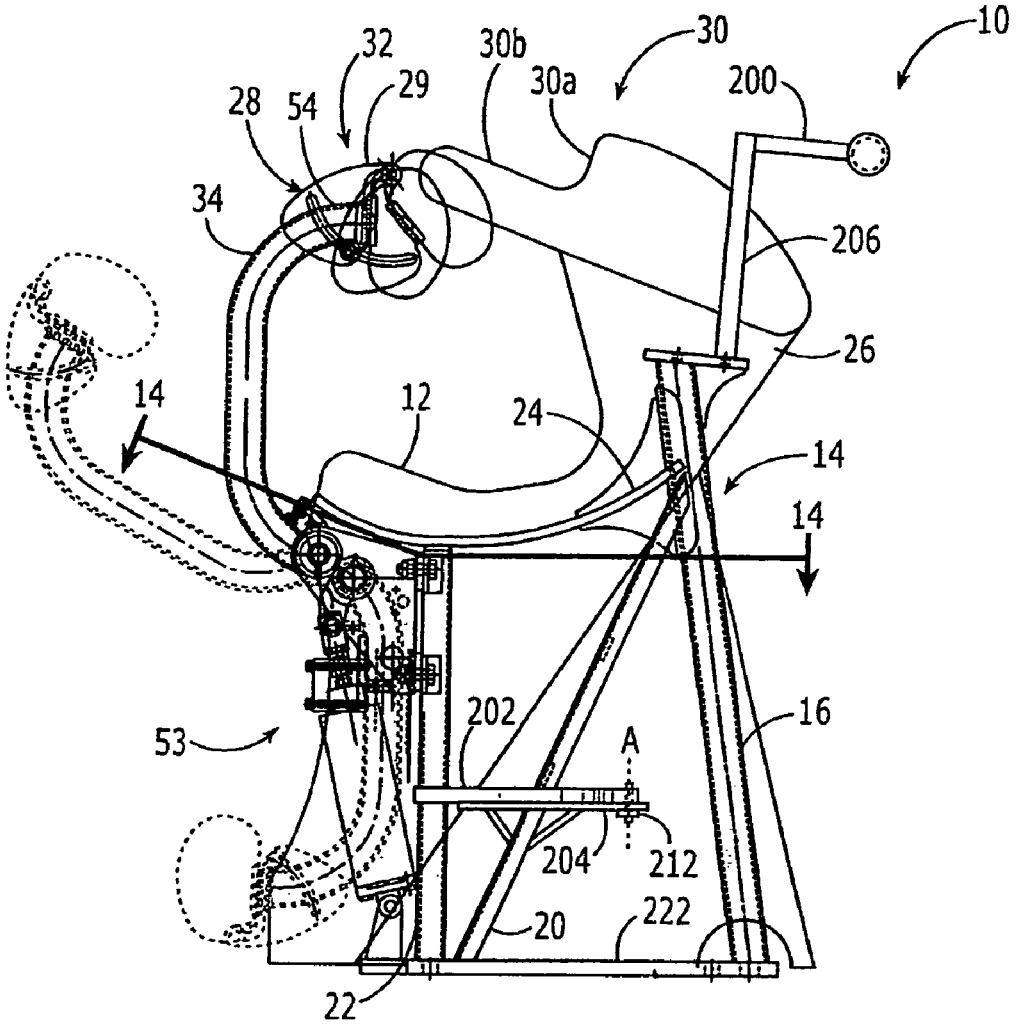
FIG. 13E is a side view of the seat illustrated in FIG. 13A with a frame exposed and leg extension elements retracted.
Figure 14:
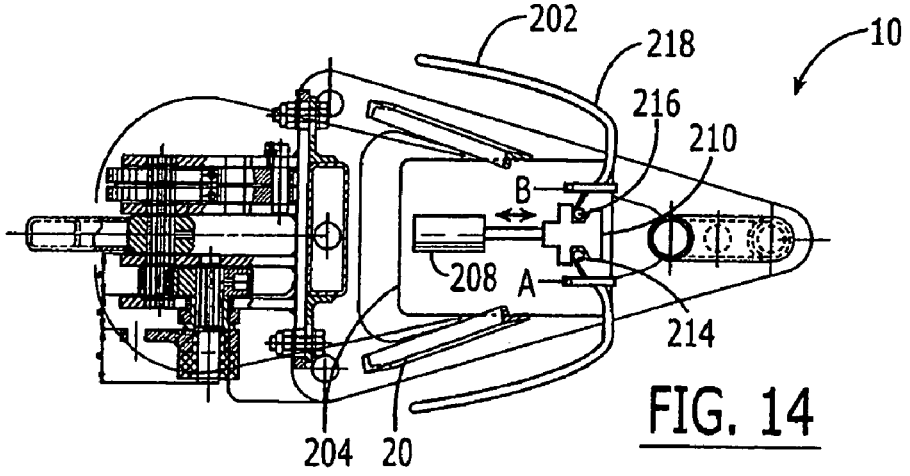
FIG. 14 is a view of the seat illustrated in FIG. 13A from above in which some components are illustrated in cross-section taken along the line 14-14 illustrated in FIG. 13E.
Figure 15:
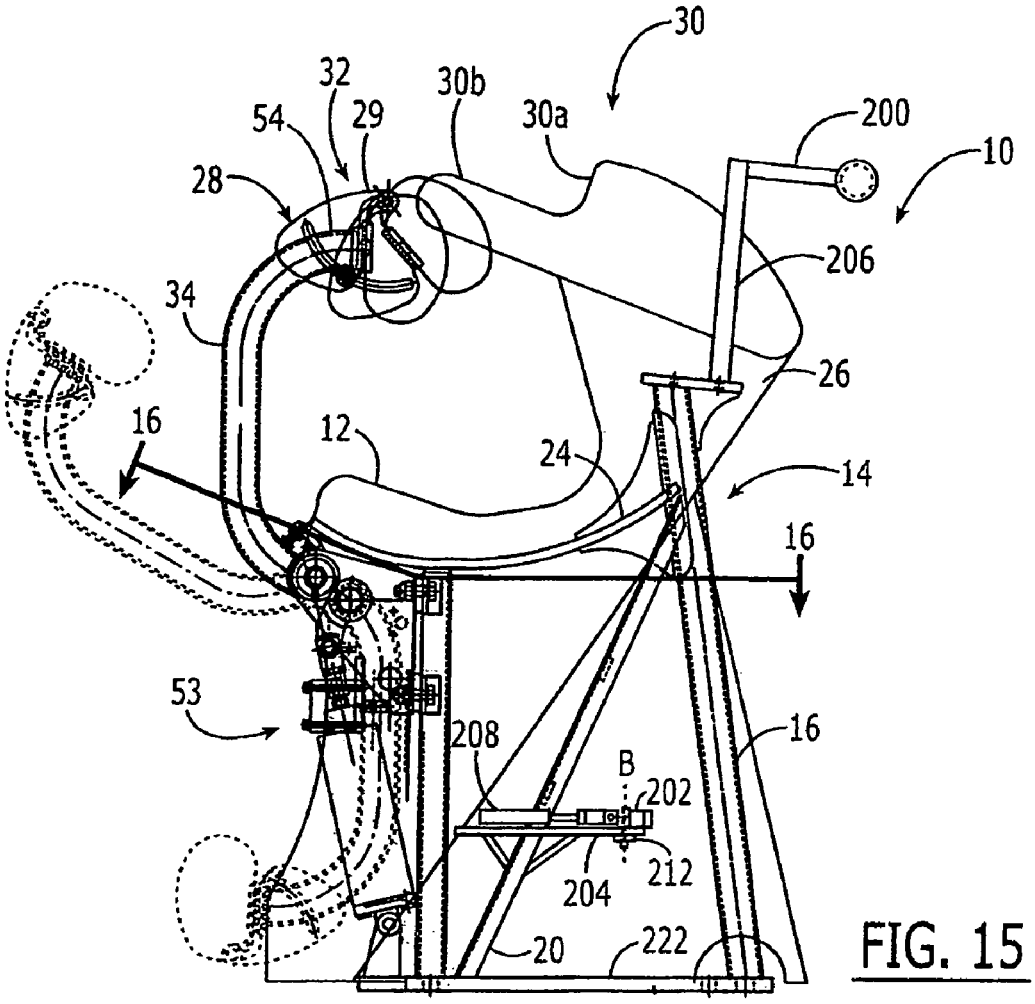
FIG. 15 is a side view of the seat illustrated in FIG. 13A with the frame exposed and the leg extension elements extended.

Cover or casing 26 may be in the form of a motorcycle, as illustrated in FIGS. 13A to 13D. Cover or casing 26 may be made, for example, from fiberglass. The seat 10 may include handlebars 200 and leg extensions 202, which may sit behind a user's knee to maintain the user's legs in a crouched motorcycle-like riding position. As illustrated, for example, in FIGS. 13E to 16, leg extensions 202 on either side of the seat 10 move between a retracted position, in which they lie against the cover or casing 26, and an extended position, in which they project out from each side of the cover or casing 26. A cushion 29 may be fixed to one end of arm 34, as illustrated in FIGS. 13 and 13A, or pivotally connected to arm 34, as illustrated in FIGS. 13E and 15. The mechanism used to position arm 34, as illustrated in FIGS. 13E and 15, is the same as that used in the seat illustrated in FIG. 1 except that it is adjusted to fit in the motorcycle shaped casing 26. A portion of arm 34 sits inside a recess 35 in a back wheel portion 37 of the casing when in the lowered position and sits in a recess 39 above the back wheel portion 37 when in the raised position.

Figure 16:
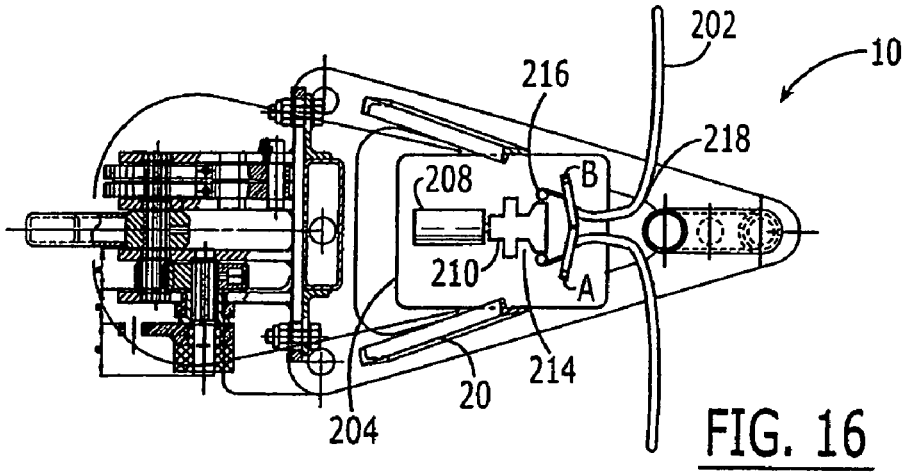
FIG. 16 is a view of the seat illustrated in FIG. 13A from above in which some components are illustrated in cross-section taken along the line 16-16 illustrated in FIG. 15.

FIGS. 13E and 15 are side views of the seat illustrated in FIG. 13A with the leg extensions 202 in the retracted and extended positions, respectively. FIGS. 14 and 16 are top views the seat illustrated in FIG. 13A, in which some components are illustrated in cross-section taken along the lines 14-14 and 16-16, with the leg extension 202 in the retracted and extended positions, respectively. For clarity, only a portion of the cover or casing 26 is illustrated in FIGS. 13E and 14 to 16 exposing the frame 14. An upward extending member 206 connects the handlebars 200 to the frame 14. A support plate 204 connected to the frame 14 is used to support the leg extensions 202, which are pivotally connected to the support plate 204 along axis A and axis B (behind axis A), as illustrated in FIGS. 13E and 15, at points A and B, as illustrated in FIGS. 14 and 16.

Conventional actuation devices, such as, for example, one or more motors, pumps, servos or hydraulic or gas pistons, may be used to move the leg extensions 202 between the retracted and extended positions. The actuation device may be, for example, pneumatic, hydraulic, electrical, etc. Further, leg extensions 202 may be manually pivoted and locked in position using gears, cranks, cams, levers, etc. As illustrated in the top views of FIGS. 14 and 16, a piston 208 having a trigger head 210 may be used to pivot the leg extensions 202 about points A and B between the retracted position (see, e.g., FIGS. 13E and 14) and the extended position (see, e.g., FIGS. 15 and 16). Piston 208 may be flipped or reoriented such that it extends in the direction toward seat 10 and retracts away from seat 10.

As illustrated in the side views of FIGS. 13E and 15, a biasing element, such as a torsion spring 212, for example, may be used to bias the leg extensions 202 in the retracted position against the cover or casing 26. Trigger head 210 may have a recess 214 on each of opposing sides, which may pull a catch portion 216 on each of the leg extensions 202. As the trigger head 210 is pulled by the piston 208 toward the seat 10, i.e., from the position illustrated in FIG. 14 toward the position illustrated in FIGS. 15 and 16, the catch portion 216 of each leg extension 202 may be pulled toward the seat forcing one leg extension 202 to pivot about point A and the other leg extension 202 to simultaneously pivot about point B. The catch portions 216 of each leg extension 202 may rotate in the recesses 214 on either side of the catch portion as the trigger head 210 moves in the direction of the arrow illustrated in FIG. 14. As the leg extensions 202 are extended, a portion 218 of each leg extension 202, previously outside the cover or casing 26, may be drawn into the cover or casing 26 through a port or hole 220 (see, e.g., FIGS. 13 and 13A) on each side of the cover or casing 26.

Plate 204 may be connected to other portions of frame 14, e.g., frontal supporting member 16 alone, frontal supporting member 16 and lateral supporting members 20, base plate 222 alone, etc.

Figure 17A:
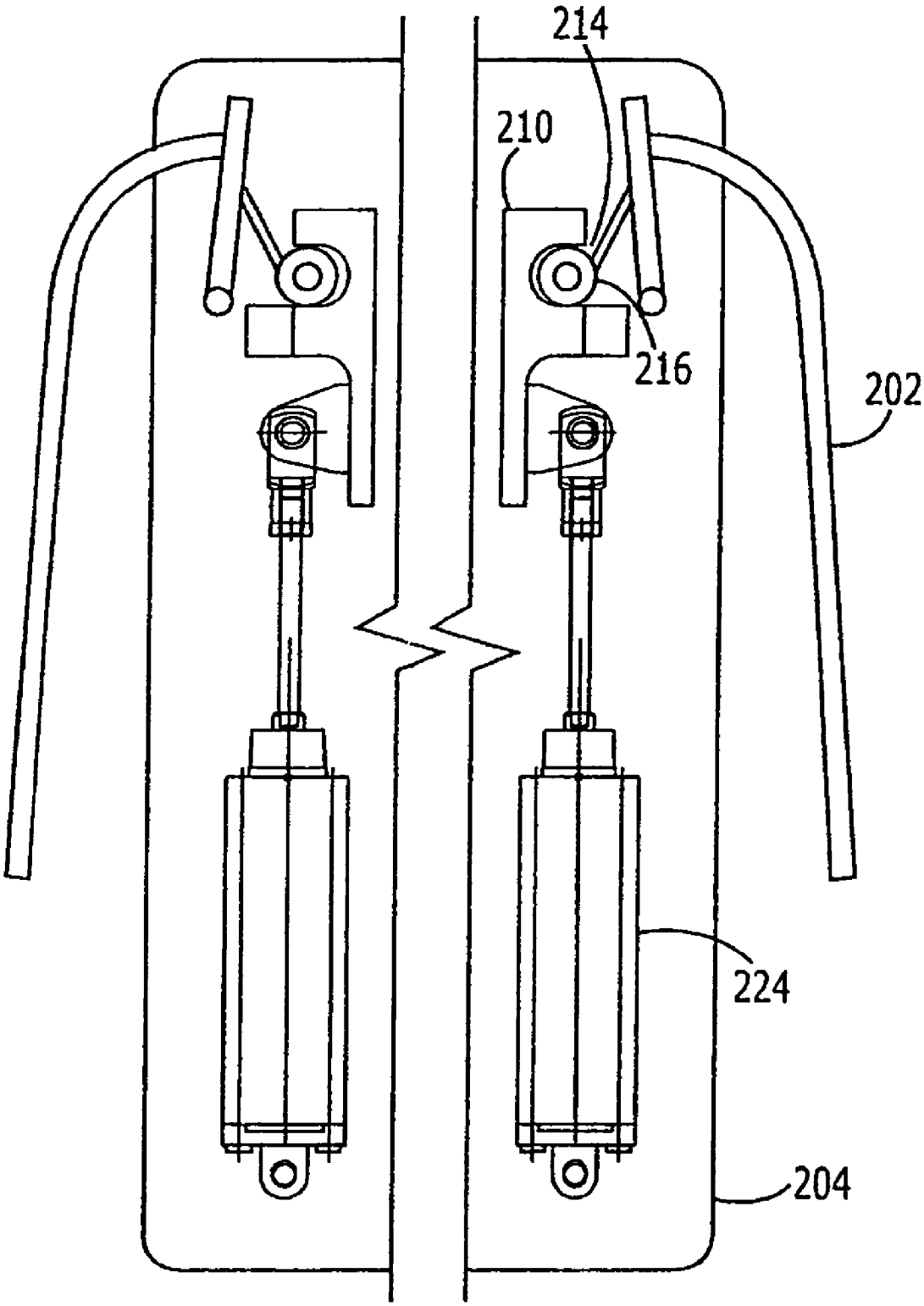
FIG. 17A is a top view of a mechanism for extending and retracting the leg extension element with the leg extension element in a retracted position.
Figure 17B:
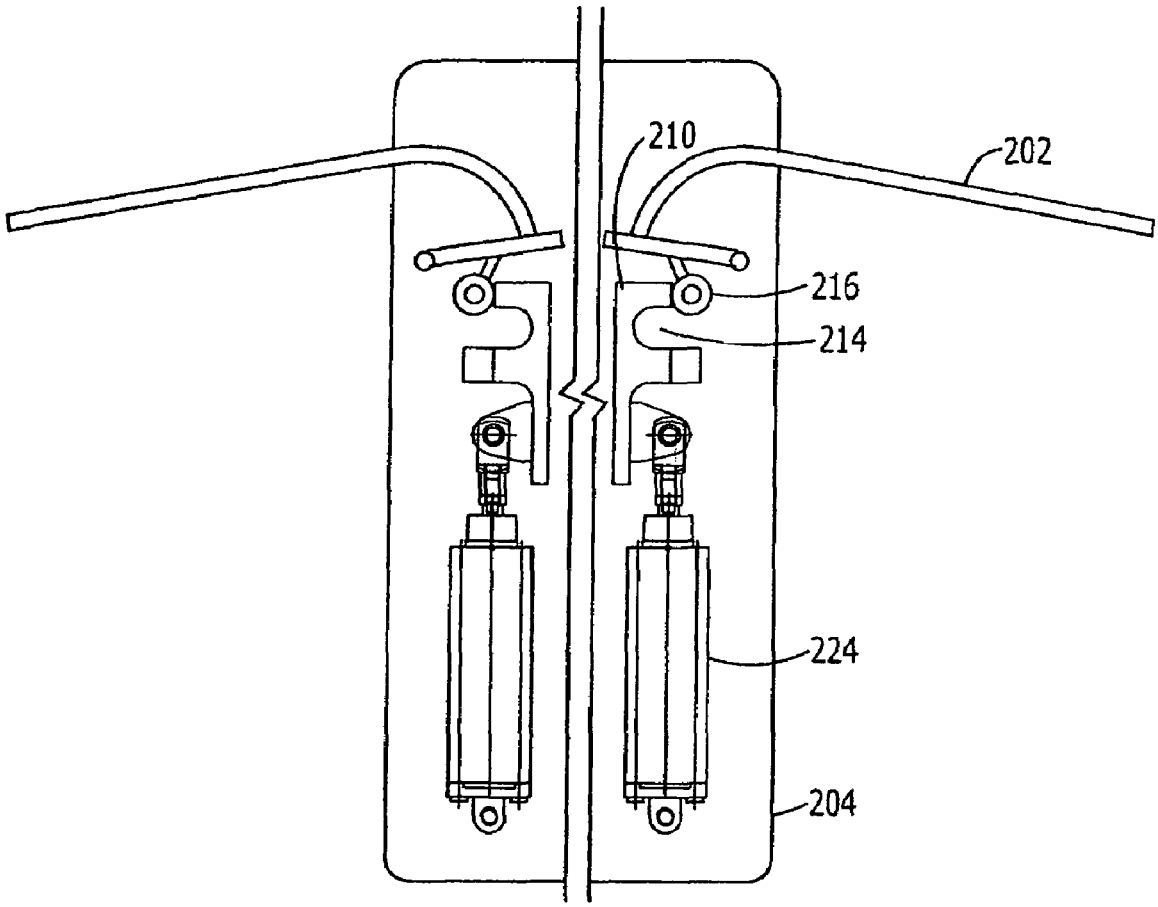
FIG. 17B is a top view of the mechanism illustrated in FIG. 17A with the leg extension element in an extended position.

The leg extensions 202 may be separately controlled by independent actuation devices. FIGS. 17A and 17B illustrate plate 204 including two separate pistons 224 for independent control of each of leg extensions 202. Pistons 224 may operate in a manner similar to that of piston 208. The leg extensions are illustrated in the retracted state in FIG. 17A and in the extended state in FIG. 17B.

The leg extensions 202 may each be independently controlled by a motor capable of forcing rotation of each leg extension about its respective pivot axis. The motors may be directly mounted on plate 204. Further, a single motor may control both leg extensions 202.

The manner in which the seat for amusement apparatus as described above is used is described below.

The user, whether a child or an adult, sits astride support 12 substantially as on a motorcycle and rests his chest or abdomen against support 30.

Figure 9:
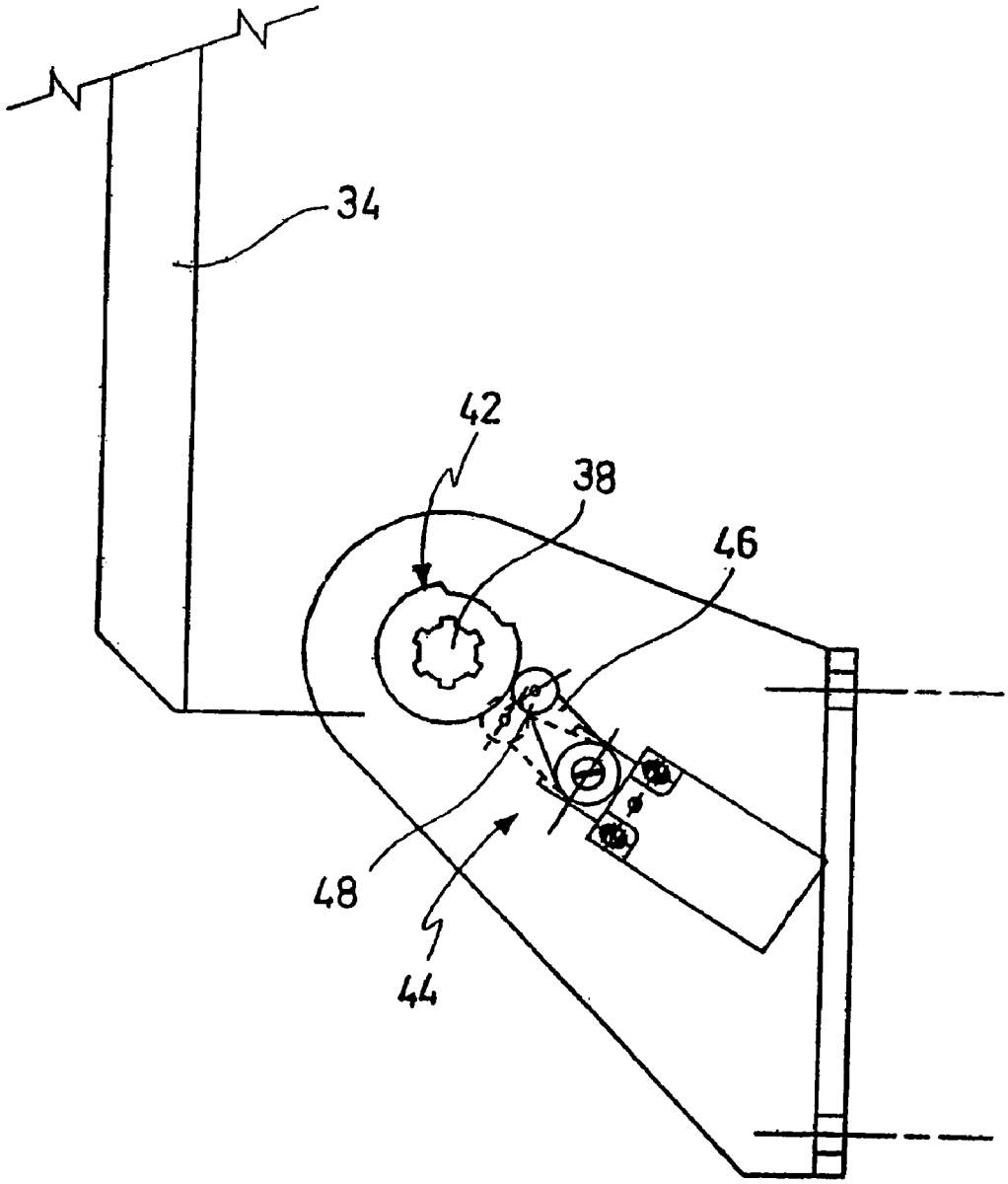
FIG. 9 is a view of a detail illustrated in FIG. 7 in cross-section taken along the line IX-IX.

On the command of an operator, actuator 36 causes splined shaft 38 and therefore arm 34 to rotate until the latter abuts against the user's back. Cam 42 and microswitch 44 constitute a control for the position of arm 34. For example, the profile of cam 42 moves with respect to small wheel 48 causing runner 46 to rotate about the hinge point (the dashed and unbroken line illustrated in FIG. 9).

Rack 50 meshes with toothed wheel 52 and keeps the arm immobilized in the raised position thus opposing the movements of the amusement apparatus and the thrust from the passenger, thus preventing the passenger from leaving the seat.

For the arrangement illustrated in FIG. 13A, on the command of an operator, piston 208 is triggered forcing leg extensions 202 to pivot about points A and B and move from the retracted position, as illustrated in FIGS. 13, 13E and 14, to the extended position, as illustrated in FIGS. 13A, 15 and 16. The leg extensions 202 project to the side away from the cover or casing 26 directly behind a user's knees maintaining the user's legs in a crouched motorcycle-riding position.

To release the passenger, single-acting piston 53 compresses the spring which maintains contact between rack 50 and toothed wheel 52, while actuator 36 causes arm 34 to make its return travel. Further, piston 208 may be triggered again, this time forcing the trigger head 210 in an opposite direction, and thus, the leg extensions 202 to the retracted position.

Figure 11:
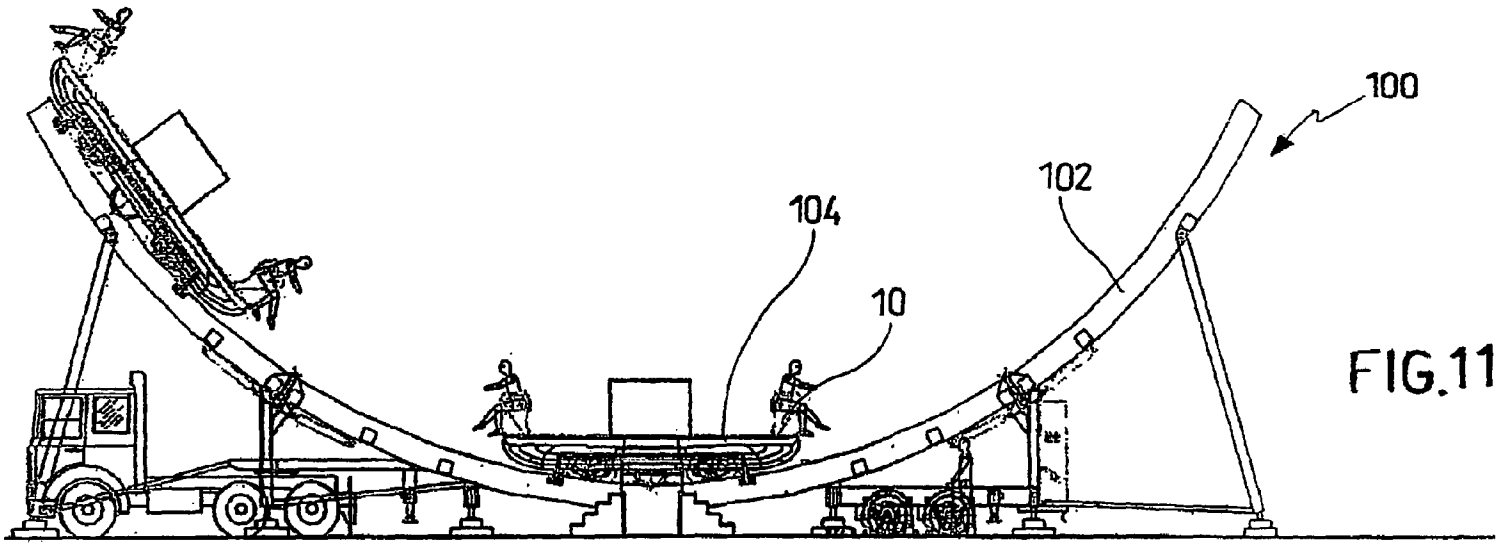
FIG. 11 is a side view of an amusement apparatus including the seat illustrated in FIG. 1.
Figure 12:
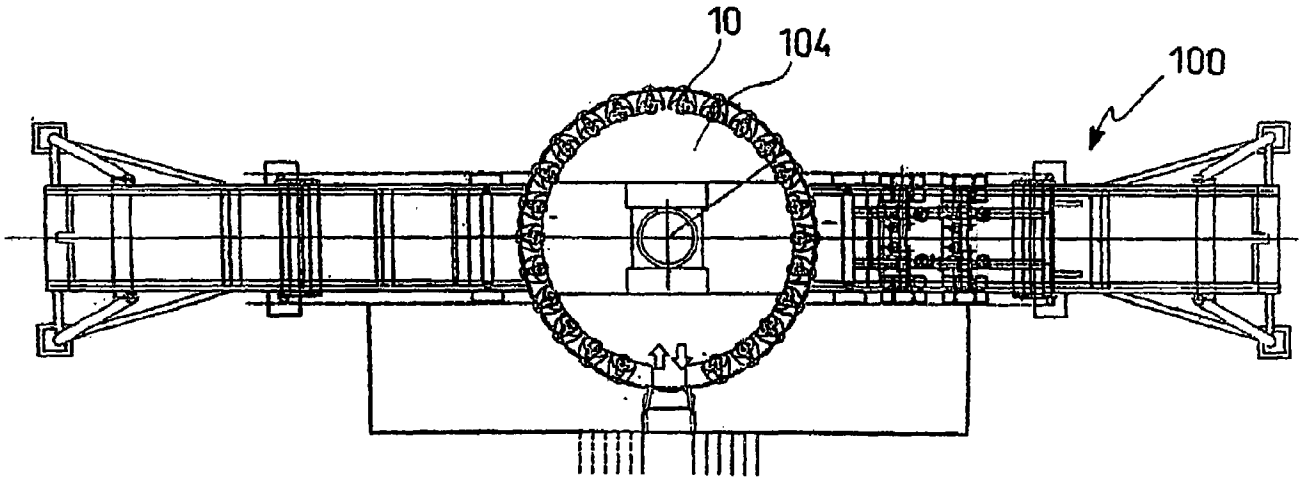
FIG. 12 is a view of the amusement apparatus illustrated in FIG. 11 from above.

An amusement apparatus provided with seats is illustrated in FIGS. 11 and 12. Reference numeral 100 indicates the apparatus as a whole including at least one track 102 on which a platform 104 is movable. Platform 104 is mounted such that it can rotate about an axis, for example, an axis substantially perpendicular to the plane defined by the platform.

At least one set of seats 10 is mounted on a substantially perimetral portion of the platform, e.g., such that the user faces outwardly from the platform.

The motion to which the user is subjected is the combination of the rotatory motion and the oscillatory motion of the platform. Provision may also be made for movement of the seats with respect to the platform.

It should be appreciated that the provision of a seat for amusement apparatus as described herein makes it possible to satisfy the requirement for obtaining a different position of the user on the apparatus, changing the sensations provoked in the user without the need for any drastic modification in the structure of the apparatus.

The seat leaves the user's shoulders free and allows him to adopt a position similar to that adopted by motorcyclists. Provision may be made for the opposing device to rotate or move laterally with respect to the support.

The motion of the opposing device, and, e.g., the arm, can be brought about by devices other than those described and illustrated. For example, arm 34 may have a substantially circular shape with one toothed side suitable for meshing with a toothed wheel driven by the actuator.

As an alternative, the frontal support may be movably mounted on the seat so that its position can be adjusted according to the user's dimensions. In this instance, a continuous adjustment or a stepwise adjustment may be provided, or movement may be permitted to assist access from the side.

The seat 10 may be substantially reversed with the provision of a movable frontal support and a fixed rear support. In each instance, the passenger sits astride the seat with his shoulders free. The frontal support may rotate or move linearly.

An amusement apparatus may be provided with the seat illustrated in FIG. 13A, as illustrated in FIGS. 18A to 18G. The amusement apparatus may also be provided with the seat 10 illustrated FIG. 1. Reference numeral 300 indicates the apparatus as a whole including at least one track 302 on which one or more platforms 304 can move. Platforms 304 may be mounted such that they can move along the track 302. Track 302 may include support rails 306 and cross beams 308.

Figure 18A:
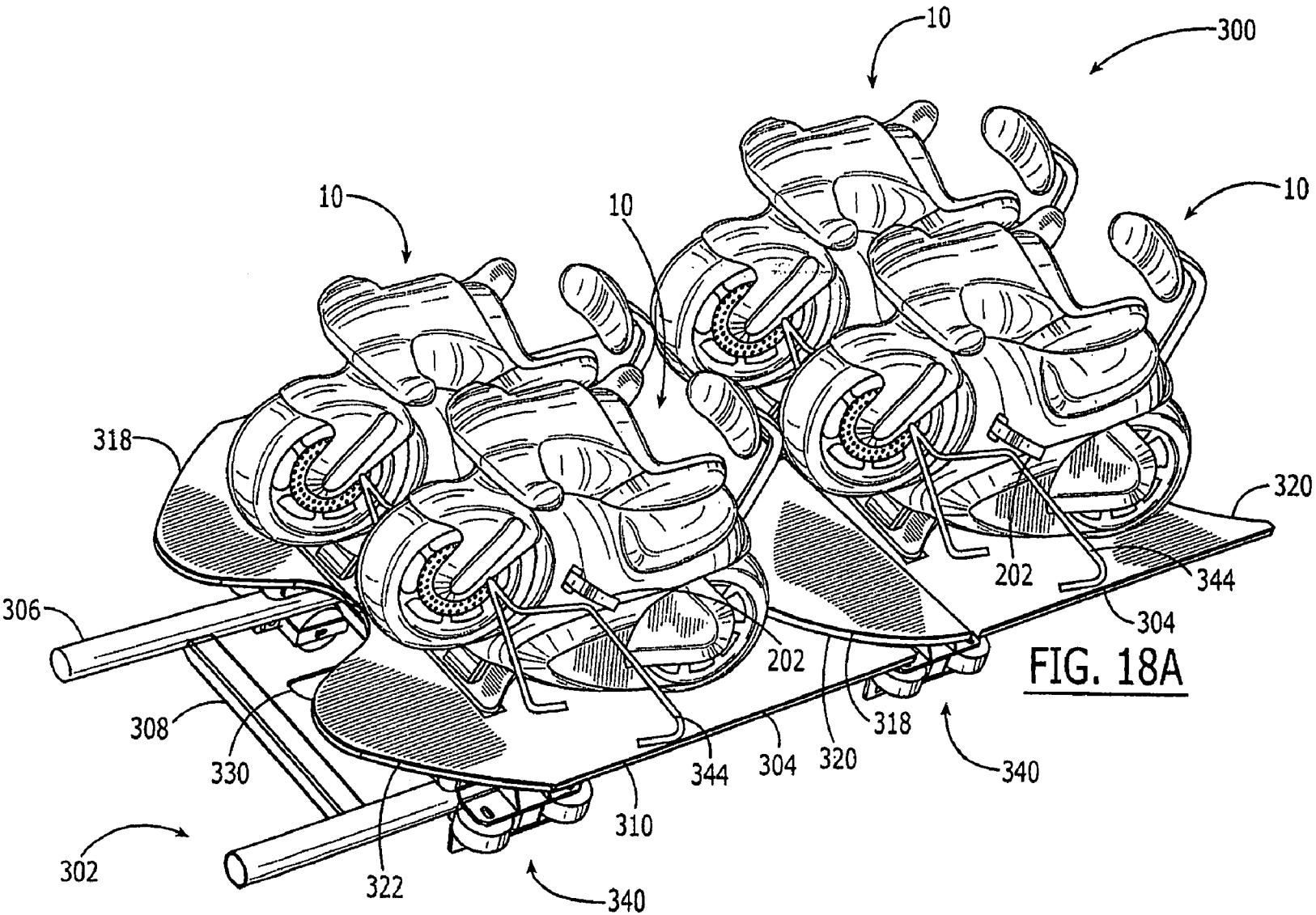
FIG. 18A is a perspective view of an amusement apparatus including the seat illustrated FIG. 13A.
Figure 18B:
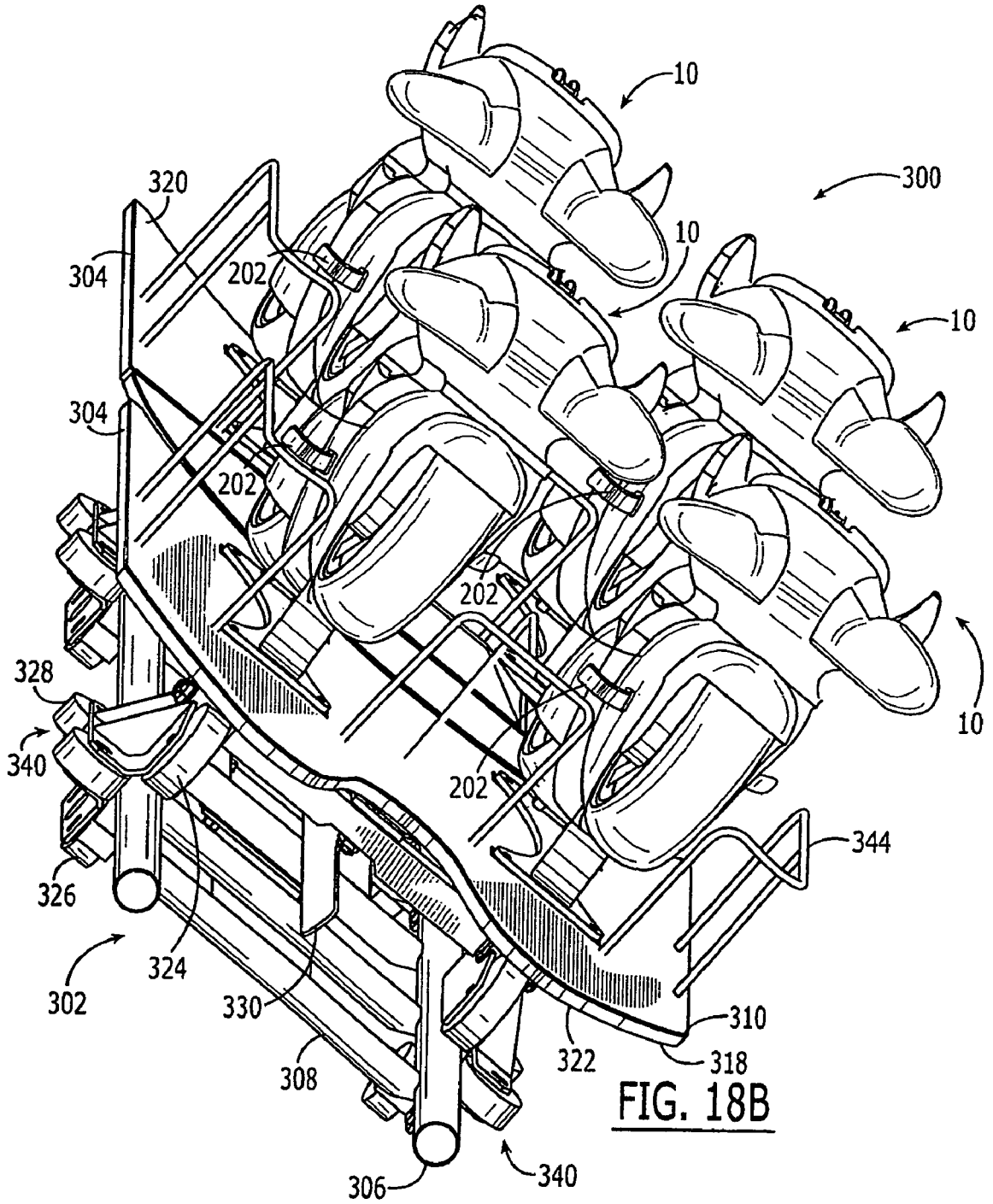
FIG. 18B is a perspective view of the amusement apparatus illustrated in FIG. 18A.
Figure 18C:
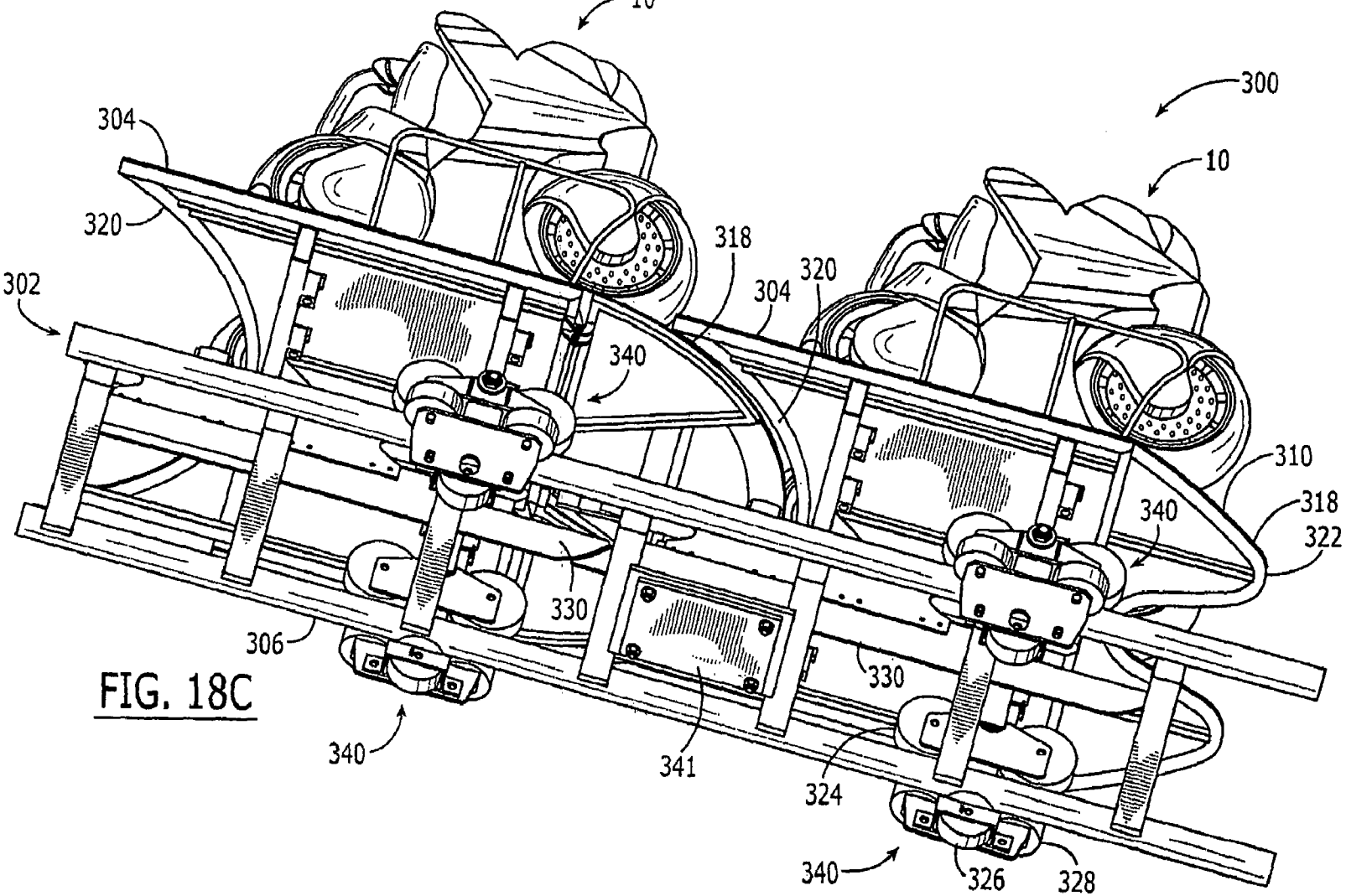
FIG. 18C is a perspective view of the amusement apparatus illustrated in FIG. 18A.
Figure 19:
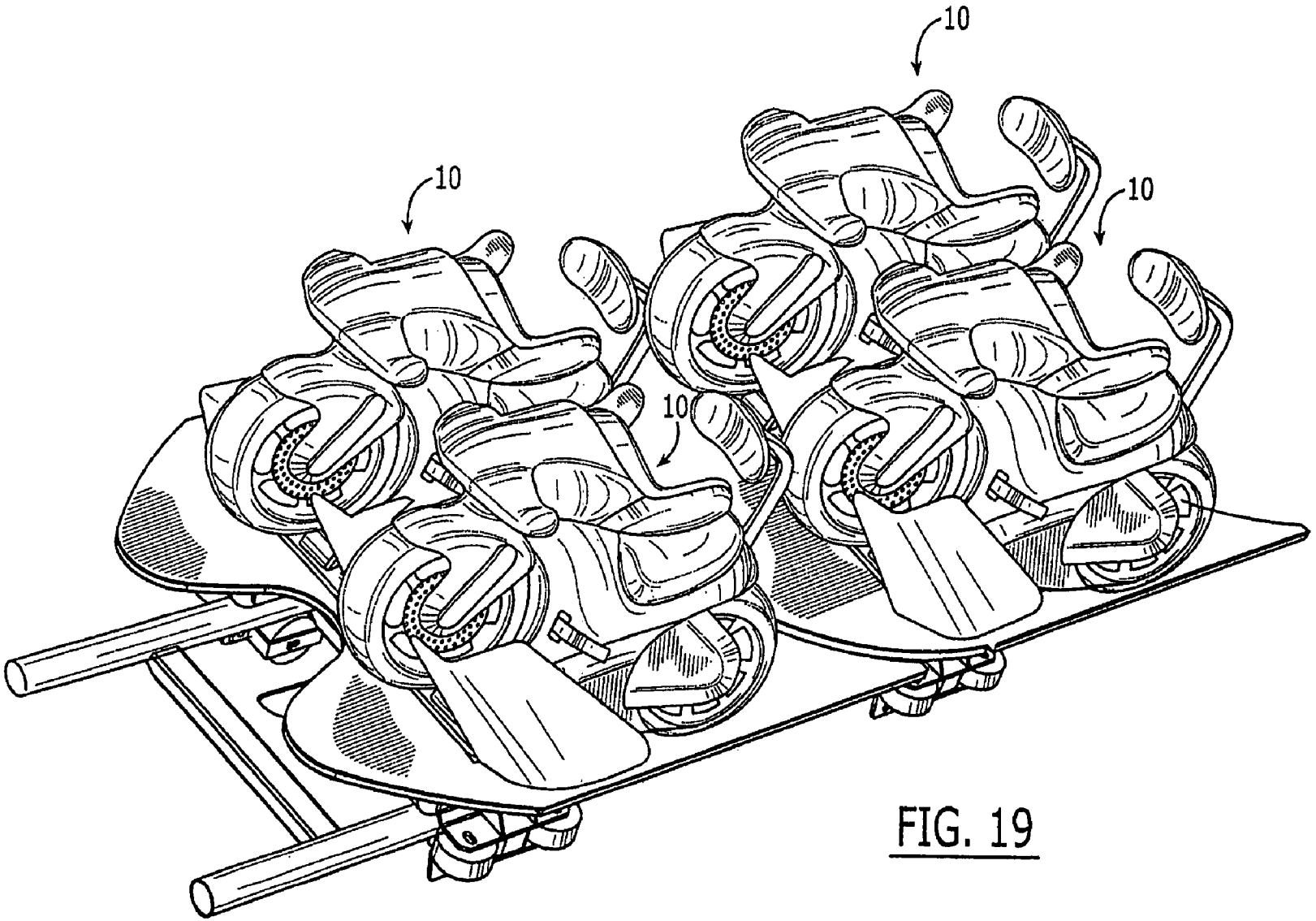
FIG. 19 is a perspective view of an amusement apparatus including the seat illustrated in FIG. 13A.

At least one seat 10 may be mounted on each of the platforms 304. The seat 10 may be situated on each platform 304 such that the length of the seat 10 extends along a longitudinal axis of the support rails 306 and such that a rider faces the direction of travel of the seat 10. As illustrated in FIGS. 18A to 18C, two seats 10 are connected side-by-side on each platform 304. One or more foot guards 344 may be connected to each platform 304 to provide that a user's feet do not extend off the platform 304. The foot guard 344 may, for example, be constructed of tubing, as illustrated in FIG. 18A, or a sheet of material, such as plexiglass, as illustrated in FIG. 19.

Figure 18D:
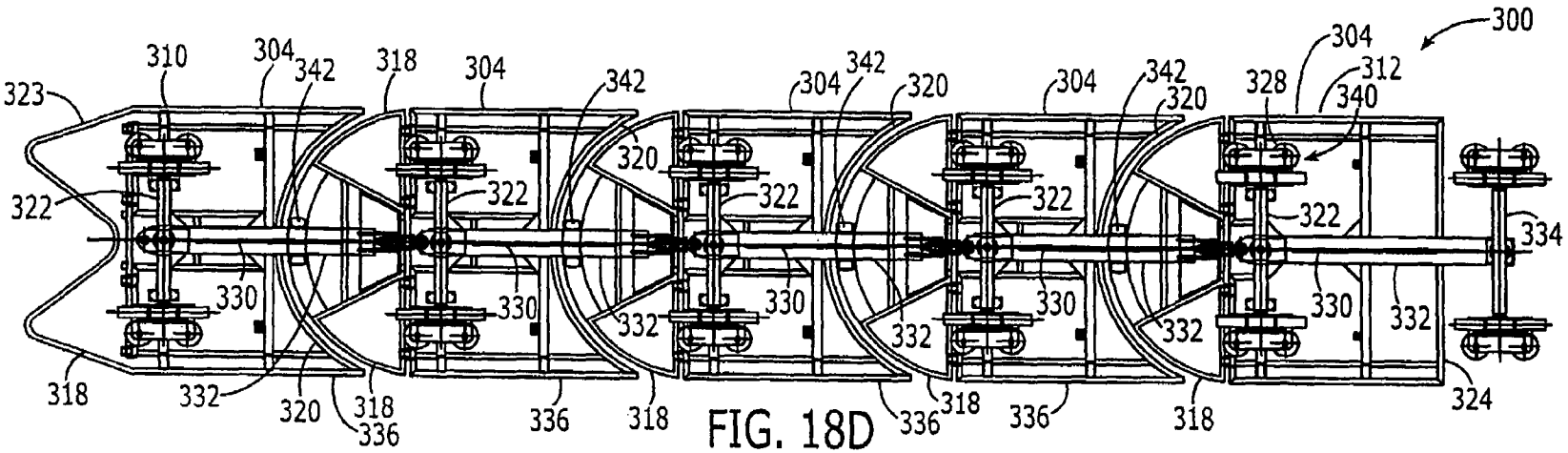
FIG. 18D is a bottom view of the amusement apparatus illustrated in FIG. 18A including three additional sections.
Figure 18E:
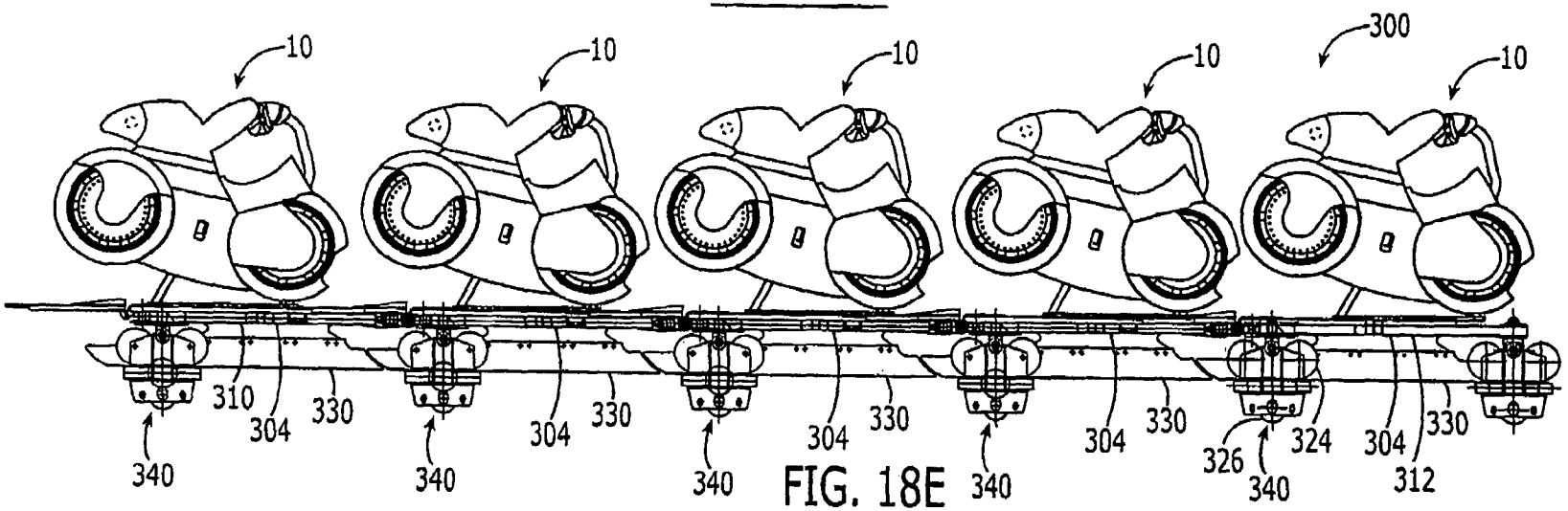
FIG. 18E is a side view of the amusement apparatus illustrated in FIG. 18A including three additional sections.
Figure 18F:
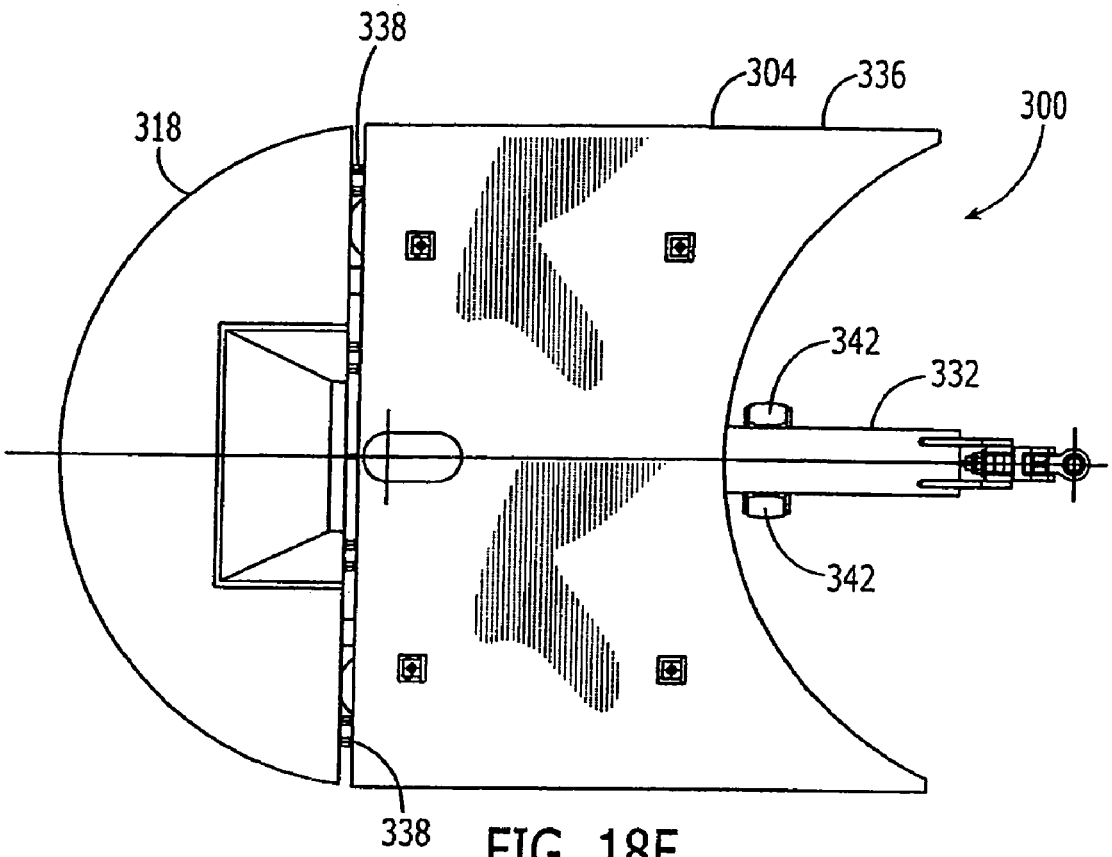
FIG. 18F is a top view of a single seat platform with the seats removed.
Figure 18G:
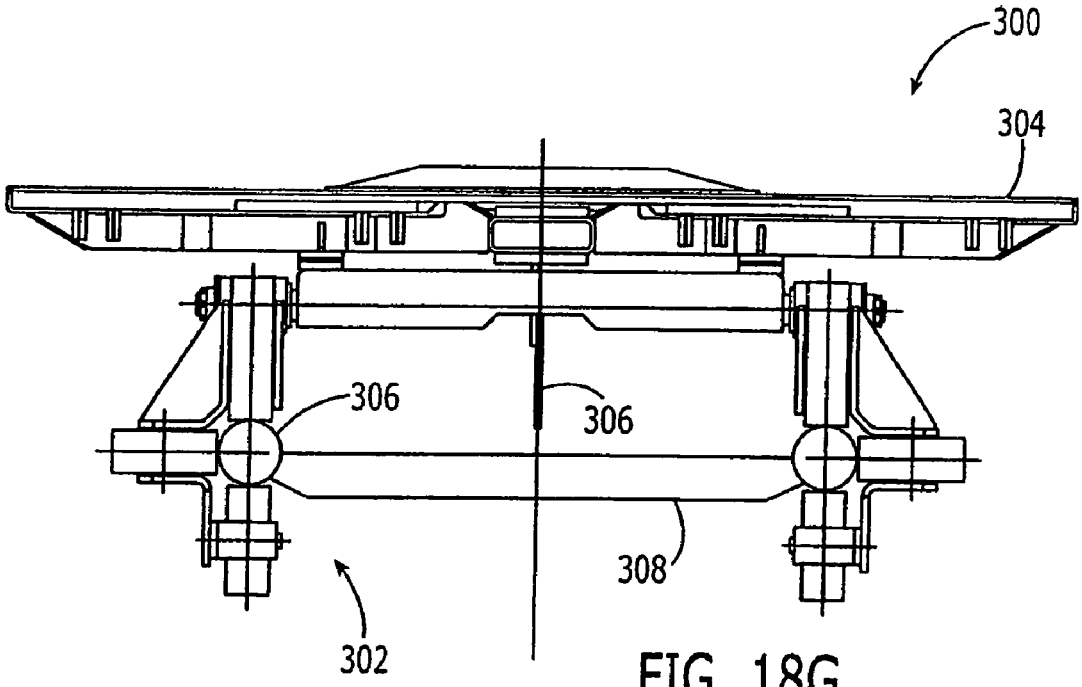
FIG. 18G is a back view of the single platform illustrated in FIG. 18F mounted on a amusement apparatus rail.

The amusement apparatus 300 may include one or more platforms 304. As illustrated in FIGS. 18D and 18E, the amusement apparatus 300 may include five platforms including a leading platform 310 and a trailing platform 312. Only the leading two of the five platforms 304 are illustrated in FIGS. 18A to 18D. Each of the platforms 304 has a leading edge 318 and a trailing edge 320. The leading platform 310 may include a solid supporting surface having a contoured w-shaped leading edge 323. The trailing platform 312 may have a straight trailing edge 324 that extends transverse to the supporting rails 306. Each of the remainder of the platforms 304 may have a convex leading portion 318, for example, in the shape of a half circle, and a trailing portion 336 having a mating or complementary concave trailing edge 320, for example, in the shape of a half circle. The platforms 304 may be interconnected such that the convex leading edge 318 of each platform 304 fits in the concave trailing edge 320 of an adjacent platform 304.

The leading portion 318 on a given platform 304 may be pivotally connected, for example, via hinges 338 (see, e.g., FIG. 18F), to the trailing portion 336 so as to allow the platform 304 to enter horizontal and vertical curves with tighter radii. The leading platform 310 is illustrated as a solid planar support unit but may also include one or more hinged sections.

Each platform 304 may be supported by a front axle 322 which may connected to and roll on each of the supporting rails 306 via a bogie 340, which may include, for example, two road wheels 324, one up-stop wheel 326 and two guide wheels 328. Pulley axles 332 may interconnect each of the front axles 322 and may be pivotably and rotatably connected on each end to the front axles 322. A trailing end of the pulley axle 332 of the trailing platform 312 may be connected to an independent axle 334, which is not used to support a platform 304.

As indicated above, the platforms 304 may be interconnected such that the convex leading portion 318 of each platform 304 partially fits in the concave trailing portion 336 of an adjacent platform 304. As illustrated in FIG. 18D, rollers 342 may be connected to each of the pulley axles 332 such that the leading portion 318 may roll on rollers 342 and rotate within the adjacent trailing portion 336.

The pulley axles 332 may interconnect the platforms 304 directly, i.e., they may be pivotally connected on both ends to the adjacent platforms, as opposed to being connected to the adjacent front axles 322.

Figure 20:
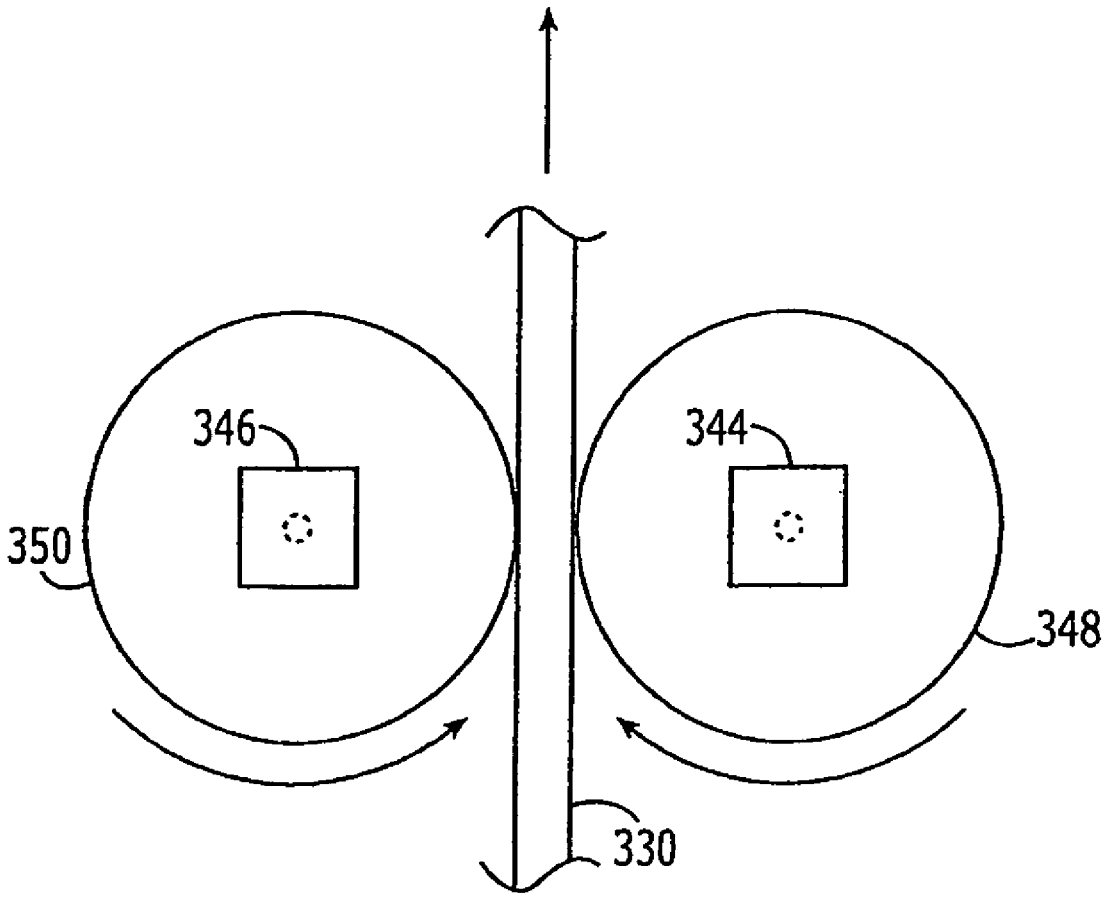
FIG. 20 schematically illustrates a pair of kicker motors used to propel the platforms.

Each of the pulley axles 332 may include a fin 330 projecting downwardly away from the platform 304 toward the track cross members 308. As illustrated in FIG. 20, one or more propulsion mechanisms, including, for example, a pair of kicker motors 344, 346, may be connected to the track 302 and used to propel or brake the seats 10 via, for example, rolling contact of wheels 348 and 350 with the fins 330. Motors 344, 346 are illustrated freestanding and independent of the track 302 for clarity but may be mounted on the track, for example, to an upper surface of a support plate 341 (see, e.g., FIG. 18C).

The track 302 may twist and turn and be supported via conventional structures. The propulsion mechanisms may add potential energy to the train, i.e., the interconnected platforms 304, by driving the train to the top of a lift hill. Once the center of gravity of the train crests the apex of the lift hill, gravity may be used to propel the train throughout the remainder of the track 302.

A ride control system may be provided including, for example, a programmable logic controller (PLC), so as to monitor and actuate all necessary ride components such as the restraint releases, leg extensions 202, kicker motors 344, 346, etc. The ride control system may include proximity sensors and photo eyes.

An amusement apparatus provided with the seat illustrated in FIG. 13A is illustrated in FIGS. 21 to 25. The amusement apparatus may also be provided with the seat 10 illustrated FIG. 1, with any other type of seat or rider support, or with no seat or support at all.

Figure 21:
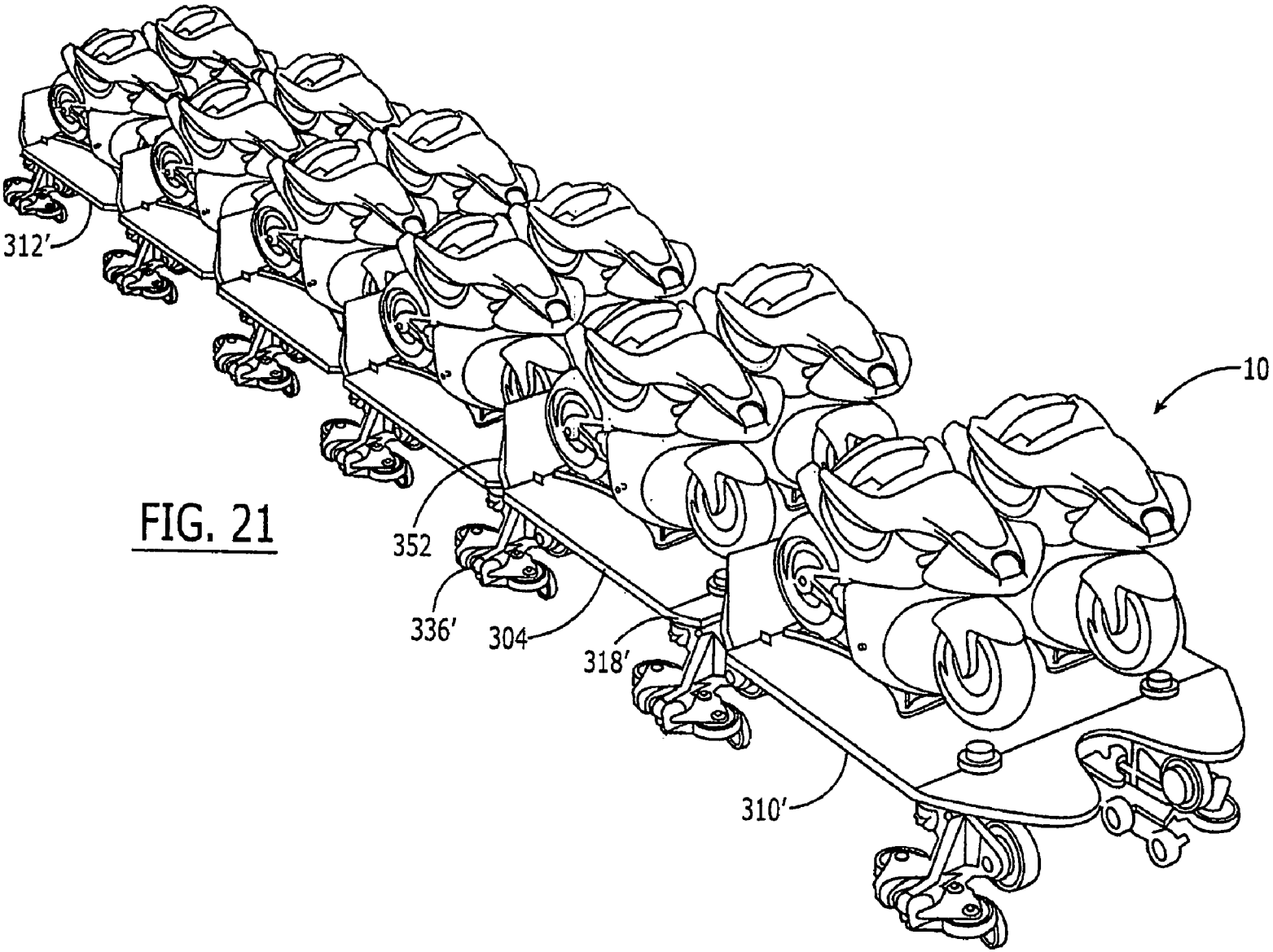
FIG. 21 is a perspective view of an amusement apparatus with a plurality of interconnected platforms having a pivoting portion in an upright position.
Figure 22:
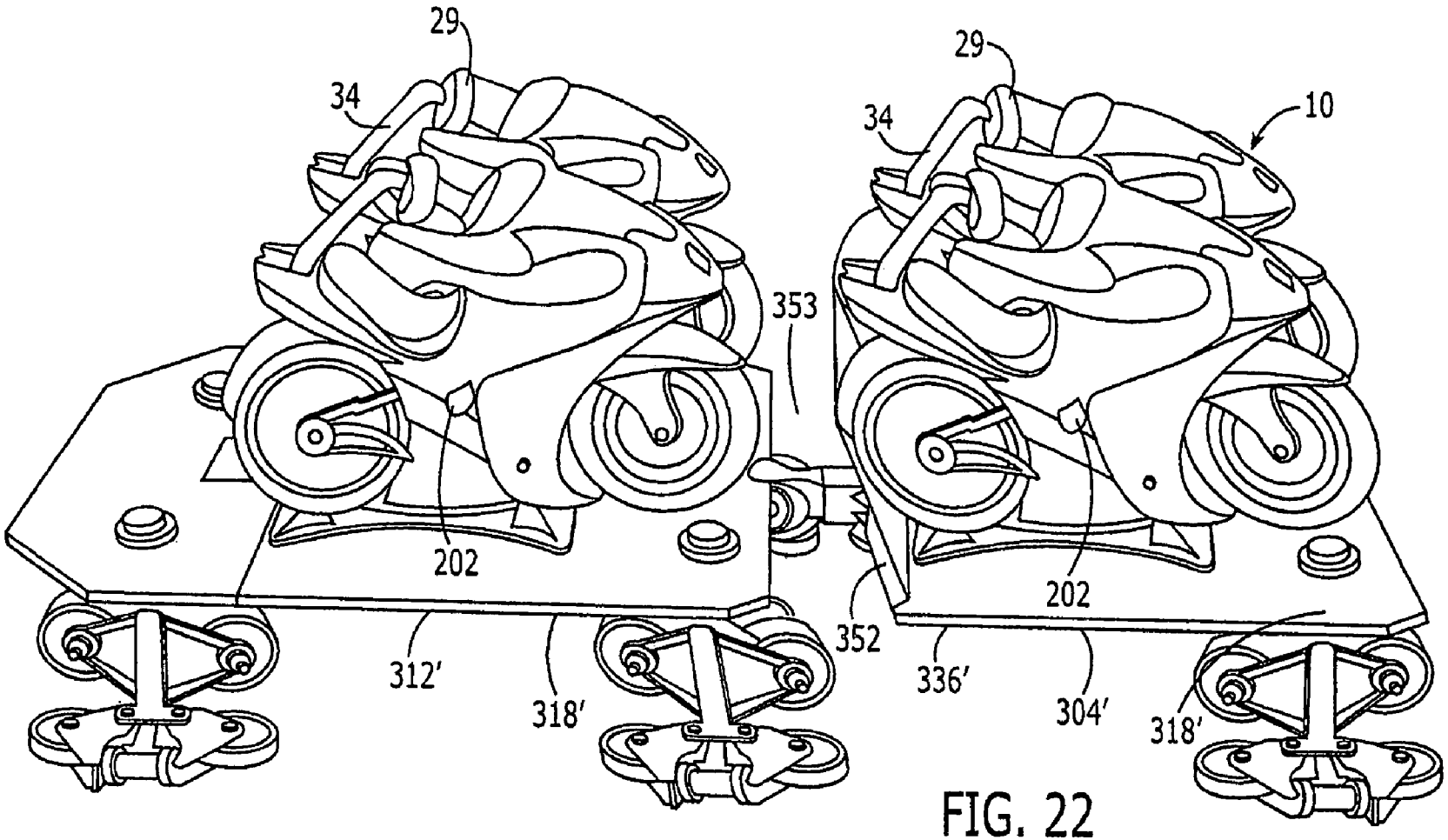
FIG. 22 is a perspective view of the two trailing platforms illustrated in FIG. 21.
Figure 23:
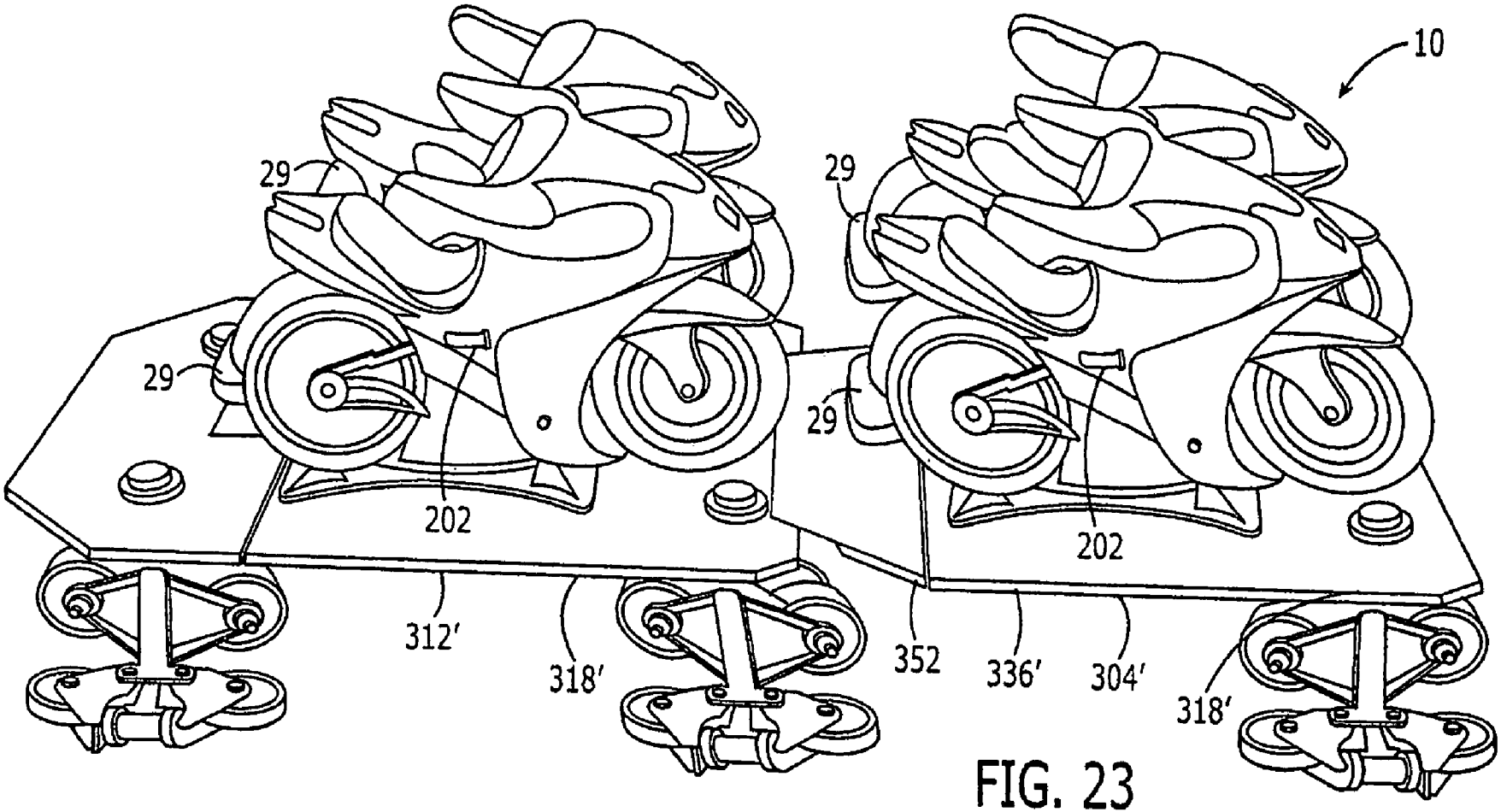
FIG. 23 is a perspective view of the two trailing platforms illustrated in FIG. 22 with the pivoting portions in a lowered position.

As illustrated in FIG. 21, the amusement apparatus includes multiple interconnected platforms 304'. The platforms 304', however, have a different shape and include a bridging portion, such as pivoting portion 352, which is used to bridge a gap 353 between the platforms 304'. A single pivoting portion 352 is pivotally connected, for example, to the trailing portion 336' of each platform 304' except for the trailing platform 312'. FIG. 22 is a close up view of two adjacent platforms 304' including the trailing platform 312' with the pivoting portion 352 in the upright position. The pivoting portion 352 is illustrated in the lowered position in FIG. 23. In this lowered position, the pivoting portion 352 bridges the gap 353 between the adjacent platforms 304'.

Figure 24:
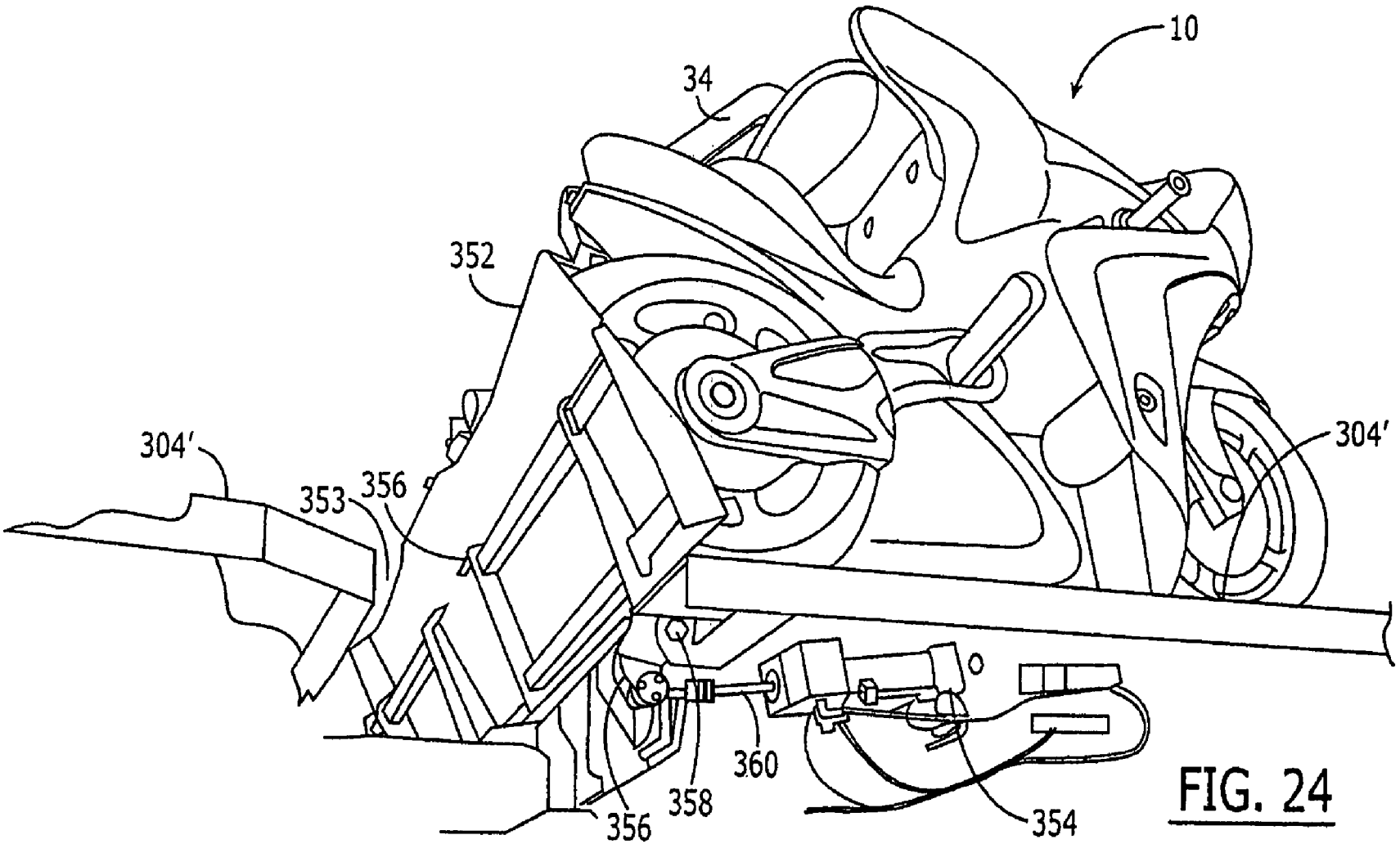
FIG. 24 is a perspective view of one of the platforms illustrated in FIG. 21 with the pivoting portion in the upright position.
Figure 25:
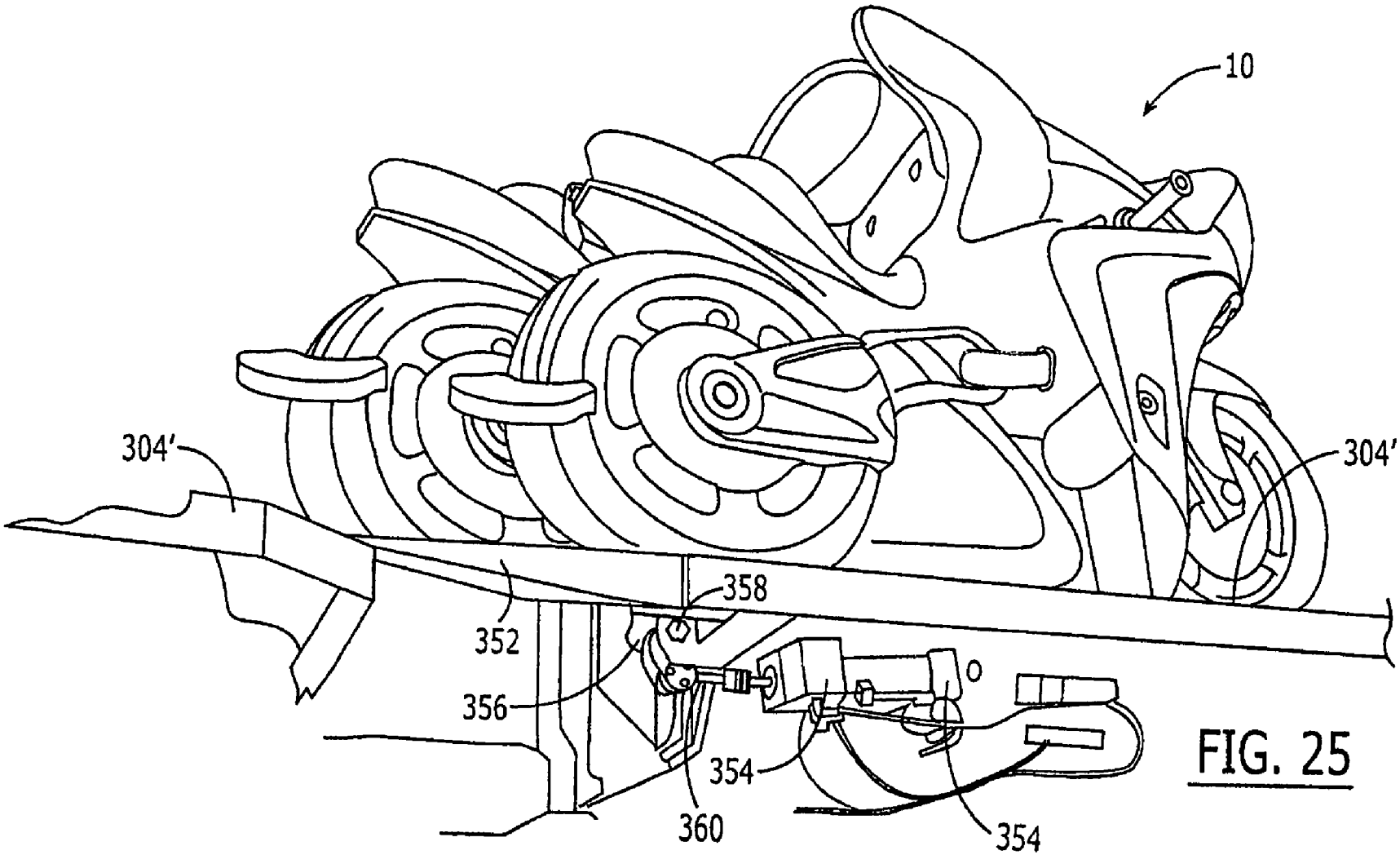
FIG. 25 illustrates the platform shown illustrated in FIG. 24 with the pivoting portion lowered.

The pivoting portion 352 may be manually moved between the lowered position and the upright position using, for example, gears, cranks, cams, levers, etc., or moved automatically using, for example, one or more pneumatic or hydraulic cylinders, gas pistons, motors, pumps, servos, etc. As illustrated in FIGS. 24 and 25, a pneumatic piston 354, for example, connected to a bottom of the platform 304' is pivotally connected to an arm 356 used to pivot the pivoting portion 352 about pivot point 358. Piston 354 is illustrated in an extended state in FIG. 24 holding pivoting portion 352 in the upright position. The piston 354 may be blocked in this position by a serial system, which may be optionally be installed on piston 354. Withdrawal of rod 360 into piston 354, as illustrated in FIG. 25, lowers the pivoting portion 352 to its lowered position.

As illustrated, pivoting portion 352 is connected to the trailing portion 336' of platforms 304'. However, pivoting portion 352 may also be connected to the leading portion 318' of platforms 304' in which case each pivoting portion 352 would be lowered onto the trailing portion 336' of the platform 304' ahead of it to bridge the gap 353 between the platforms 304'.

The ride control system may be configured to lower the pivoting portion when each of the platforms 304' are in proximity to a predetermined point on a loading/unloading area for the amusement apparatus. Each platform 304' may include a switch, e.g., a proximity switch, which may be triggered when the platform 304' reaches its respective predetermined point on the loading/unloading area.

The ride control system may also be configured to lower the pivoting portion 352 when the back support or arm 34 and cushion 29 of the seat 10 is lowered and/or when the leg extensions 202 of the seat 10 are withdrawn.

The ride control system may be configured to raise the pivoting portion 352 when the amusement apparatus is in motion and/or the sensor on each platform 304' has moved away from its respective predetermined point on the loading/unloading area.

The ride control system may also be configured to raise the pivoting portion 352 to its upright position when the back support or arm 34 of the seat 10 is raised and contacting the rider's back and/or when the leg extensions 202 of the seat 10 are extended.

The pivoting portion 352 may be replaced with a bridge portion, for example, a metal sheet, that is slid into place. The bridge portion may lie on, in, or under one of the platforms and may be moved, for example, by sliding, using, for example, rollers or any of the mechanisms discussed above use to move pivoting portion 352, into position over the gap 353 between adjacent platforms 304'. The bridge portion may extend from one platform to a position adjacent an edge of an adjacent platform so as to bridge a gap between these platforms. The bridge portion may also extend over the adjacent platform similar to the pivoting portion 352.

During loading and unloading of passengers, the portion 352 may be extended to bridge a gap between the trailing edge of leading platform 304' and the leading edge of a trailing platform 304' so that passengers may embark and disembark the platforms 304', and pass between platforms 304' without or minimizing the possibility of injury due to an exposed gap. During travel of the platforms 304' around the track, the portion 352 is retracted so that movement between adjacent platforms 304' may occur without interference from the portion 352. Thus, safety to passengers may be enhanced during loading and unloading while not interfering with overall operation of the amusement device.

Rather than being provided between adjacent platforms 304' in the direction of travel of the platforms 304' along the track, the portion 352 may be arranged between adjacent platforms transverse to the direction of travel (e.g., side-by-side).

What is claimed is:

1. An amusement apparatus, comprising:

a track including support rails;

a first platform configured to move along the support rails of the track;

a second platform configured to move along the support rails of the track and interconnected with the first platform; and a bridge portion connected to a first one of (a) the first platform and (b) the second platform and moveable in a direction of a second one of (a) the first platform and (b) the second platform between a retracted position, in which a gap is formed between the first platform and the second platform, and an extended position, in which the bridge portion extends between the first platform and the second platform.

2. The amusement apparatus according to claim 1, wherein the bridge portion is pivotally connected to the first one of (a) the first platform and (b) the second platform and is moveable between the extended position, in which the bridge portion one of (a) contacts and (b) is suspended over the second one of (a) the first platform and (b) the second platform and bridges the gap between the first platform and the second platform, and the retracted position, in which the bridge portion is at a higher angle, relative to the first one of (a) the first platform and (b) the second platform, than in the extended position.

3. The amusement apparatus according to claim 2, wherein the first platform leads the second platform on the track.

4. The amusement apparatus according to claim 2, wherein the bridge portion is adapted to remain in the extended position during a loading and unloading operation of the amusement apparatus and in a loading and unloading area of the amusement apparatus.

5. The amusement apparatus according to claim 1, wherein the bridge portion is located one of (a) between a leading platform and a trailing platform and (b) between laterally adjacent platforms.

6. An amusement apparatus, comprising:

a first platform configured to move on a track;

a second platform configured to move on the track and interconnected with the first platform;

a bridge portion connected to a first one of (a) the first platform and (b) the second platform and moveable in a direction of a second one of (a) the first platform and (b) the second platform between a retracted position, in which a gap is formed between the first platform and the second platform, and an extended position, in which the bridge portion extends between the first platform and the second platform; and a pulley interconnecting the first and second platforms.

7. The amusement apparatus according to claim 6, further comprising:

a first axle connected to an underside of the first platform; and a second axle connected to an underside of the second platform, the first axle and the second axle configured to support the first and second platforms on the at least one track;

wherein the pulley is pivotally connected on one end to at least one of (a) the first axle and (b) the second axle.

8. An amusement apparatus, comprising:

a first platform configured to move on a track;

a second platform configured to move on the track and interconnected with the first platform;

a bridge portion connected to a first one of (a) the first platform and (b) the second platform and moveable in a direction of a second one of (a) the first platform and (b) the second platform between a retracted position, in which a gap is formed between the first platform and the second platform, and an extended position, in which the bridge portion extends between the first platform and the second platform;

wherein the bridge portion is pivotally connected to the first one of (a) the first platform and (b) the second platform and is moveable between the extended position, in which the bridge portion one of (a) contacts and (b) is suspended over the second one of (a) the first platform and (b) the second platform and bridges the gap between the first platform and the second platform, and the retracted position, in which the bridge portion is at a higher angle, relative to the first one of (a) the first platform and (b) the second platform, than in the extended position; and further comprising a pneumatic piston configured to move the bridge portion between the extended position and the retracted position.

9. An amusement, comprising:

a first platform configured to move on a track;

a second platform configured to move on the track and interconnected with the first platform;

a bridge portion connected to a first one of (a) the first platform and (b) the second platform and moveable in a direction of a second one of (a) the first platform and (b) the second platform between a retracted position, in which a gap is formed between the first platform and the second platform, and an extended position, in which the bridge portion extends between the first platform and the second platform; and at least one seat connected to at least one of (a) the first platform and (b) the second platform, the seat including: (i) a support configured to receive a rider astride the support; and (ii) an arrangement configured to immobilize the rider on the support, the arrangement configured to maintain shoulders of the rider free and to secure the rider on the support at least one of (a) an abdominal portion of the rider and (b) a thoracic portion of the rider.

10. The amusement apparatus according to claim 9, wherein the seat includes a pair of extensions configured to move between an extended position, in which a first one of the extensions projects outwardly from a first side of the seat and a second one of the extensions projects outwardly from a second side of the seat, and a retracted position, in which the extensions are retracted relative to the extended position.

11. The amusement apparatus according to claim 9, wherein the support includes a seat portion and a front support member and is configured to receive the rider astride the seat portion, the arrangement is configured to secure the rider at least against the front support member at least one of the abdominal portion of the rider and the thoracic portion of the rider.

12. The amusement apparatus according to claim 11, wherein the seat portion of the seat is elongated and a longitudinal axis of the seat portion is arranged to follow the track.

13. The amusement apparatus according to claim 11, wherein each platform includes two seats side-by-side.

14. The amusement apparatus according to claim 9, wherein the support includes a seat portion and a front portion situated higher than the seat portion and angled such that the rider sitting astride on the seat portion must lean forward into a forward leaning posture for at least one of the rider's (a) abdominal and (b) thoracic regions to contact the front portion of the rider support, the arrangement including a restraint moveable between a first position not contacting the rider in the forward leaning posture and a second position in which at least a portion of the restraint contacts at least a back portion of the rider in the forward leaning posture and is configured to maintain the rider in said forward leaning posture.

15. A method for operating an amusement apparatus including a track having support rails and a vehicle movable along the support rails of the track, comprising:

(a) while the movable vehicle is located in a loading and unloading position along the track, moving a bridge portion of the vehicle into an extended position between two adjacent platforms of the vehicle, in the extended position, the bridge portion extending between the platforms and spanning a gap between the platforms;

(b) after the step (a), moving the bridge portion from the extended position to a retracted position in which the bridge portion does not extend between the platform and does not span the gap between the platforms;

(c) after the step (b), moving the vehicle along the support rails of the track from the loading and unloading position and returning the vehicle to the loading and unloading position; and (d) after the step (c), repeating the step (a).

16. The method according to claim 15, further comprising at least one of (a) loading and (b) unloading passengers into the vehicle between the step (a) and the step (b).

17. The method according to claim 15, further comprising at least one of (a) loading and (b) unloading passengers into the vehicle between the steps (c) and (d).

18. The method according to claim 15, wherein the bridge portion is pivotally connected one of the platforms, the step (a) including pivoting the bridge portion into the extended portion, the step (b) including pivoting the bridge portion into the retracted position.

19. The method according to claim 15, further comprising immobilizing riders on at least one of the platforms at least one of (a) prior to and (b) simultaneously with the step (d).

20. The method according to claim 15, wherein the amusement apparatus includes at least one seat connected to at least one of the platforms.

21. The method according to claim 15, wherein the bridge portion is located one of (a) between leading and trailing platforms and (b) between laterally adjacent platforms.

* * * * *